US009316933B2

(12) United States Patent
Fukushima et al.

(10) Patent No.: US 9,316,933 B2
(45) Date of Patent: Apr. 19, 2016

(54) ELECTROPHOTOGRAPHIC PHOTORECEPTOR AND IMAGE FORMING APPARATUS INCLUDING THE SAME

(71) Applicant: SHARP KABUSHIKI KAISHA, Osaka-shi, Osaka (JP)

(72) Inventors: Kotaro Fukushima, Osaka (JP); Kimiko Kumazawa, Osaka (JP); Koichi Toriyama, Osaka (JP); Takahiro Kurauchi, Osaka (JP); Tomoko Kanazawa, Osaka (JP); Chikako Iibachi, Osaka (JP); Rikiya Matsuo, Osaka (JP)

(73) Assignee: SHARP KABUSHIKI KAISHA, Osaka-shi, Osaka (JP)

( * ) Notice: Subject to any disclaimer, the term of this patent is extended or adjusted under 35 U.S.C. 154(b) by 0 days.

(21) Appl. No.: 14/282,838

(22) Filed: May 20, 2014

(65) Prior Publication Data

US 2015/0017580 A1 Jan. 15, 2015

(30) Foreign Application Priority Data

Jul. 9, 2013 (JP) ..... 2013-143634
Jul. 9, 2013 (JP) ..... 2013-143644

(51) Int. Cl.

*G03G 5/147* (2006.01)
*G03G 5/07* (2006.01)
*G03G 5/05* (2006.01)

(52) U.S. Cl.

CPC ..... *G03G 5/071* (2013.01); *G03G 5/0503* (2013.01); *G03G 5/0539* (2013.01); *G03G 5/0592* (2013.01); *G03G 5/0596* (2013.01); *G03G 5/14708* (2013.01); *G03G 5/14726* (2013.01); *G03G 5/14791* (2013.01)

(58) Field of Classification Search

CPC ..... G03G 5/14708; G03G 5/0503; G03G 5/14726; G03G 5/14791
USPC ..... 430/66, 67, 58.05
See application file for complete search history.

(56) References Cited

U.S. PATENT DOCUMENTS 5,096,795 A * 3/1992 Yu ..... 430/58.8
5,752,140 A 5/1998 Danzuka et al.

FOREIGN PATENT DOCUMENTS

| | | |
|---|---|---|
| JP | 64-23259 | 1/1989 |
| JP | 1-172970 | 7/1989 |
| JP | 3148571 | 1/2001 |
| JP | 3186010 | 5/2001 |

OTHER PUBLICATIONS

Japanese Patent Office machine-assisted English-language translation of Japanese patent document JP 3148571 B (pub. Jan. 2001).*
Japanese Patent Office machine-assisted English-language translation of Japanese patent document JP 3186010 B (pub. May 2001).*

* cited by examiner

*Primary Examiner* — Janis L Dote
(74) *Attorney, Agent, or Firm* — Nixon & Vanderhye, P.C.

(57) ABSTRACT

An electrophotographic photoreceptor having a photosensitive layer formed on a conductive substrate, wherein the photosensitive layer contains oxygen-containing fluorinated fine particles in a surface layer thereof, and the oxygen-containing fluorinated fine particles have an oxygen composition ratio of 0.9 to 3.0% by atom based on the whole composition of the fine particles according to an X-ray fluorescence composition analysis.

9 Claims, 3 Drawing Sheets

ELECTROPHOTOGRAPHIC PHOTORECEPTOR AND IMAGE FORMING APPARATUS INCLUDING THE SAME

CROSS-REFERENCE TO RELATED APPLICATION

This application is related to Japanese Patent Application Nos. 2013-143634 and 2013-143644 filed on 9 Jul. 2013, whose priorities are claimed under 35 USC §119, and the disclosures of which are incorporated by reference in their entirety.

BACKGROUND OF THE INVENTION

1. Field of the Invention

The present invention relates to an electrophotographic photoreceptor and an image forming apparatus including the same. More particularly, the present invention relates to an electrophotographic photoreceptor in which a photosensitive layer contains oxygen-containing fluorinated fine particles in a surface layer thereof, as well as to an electrophotographic photoreceptor in which a photosensitive layer contains oxygen-containing fluorinated fine particles in a surface layer thereof and the photosensitive layer contains a charge transport material having an ionization potential of 5.25 to 5.70 eV, and to an image forming apparatus including the photoreceptor.

2. Description of the Related Art

In electrophotographic image forming apparatuses that are used as copying machines, printers, facsimile machines, and the like (hereinafter, referred to as electrophotographic apparatuses), an image is formed through the following electrophotographic process.

First, a photosensitive layer of an electrophotographic photoreceptor (hereinafter, may be referred to simply as "photoreceptor") included in an apparatus is uniformly charged at a predetermined potential by a charger.

Subsequently, the photosensitive layer is exposed to light such as laser light emitted by exposure means according to image information, thereby forming an electrostatic latent image.

A developer is supplied from developing means to the electrostatic latent image formed, and a component of the developer, that is, colored fine particles referred to as toner is attached to the surface of the photoreceptor. Thus, the electrostatic latent image is developed into a visible toner image.

The toner image formed is transferred from the surface of the photoreceptor to a transfer material such as recording paper by transfer means and fixed thereon by fixing means.

However, not all the toner on the surface of the photoreceptor is transferred to the recording paper in the transfer by the transfer means, but some of the toner is left on the surface of the photoreceptor. In addition, some paper particles from the recording paper having been in contact with the photoreceptor in the transfer may adhere to the surface of the photoreceptor and remain thereon. Having an adverse effect on the quality of an image to be formed, such foreign matters as the residual toner and the adhering paper particles on the surface of the photoreceptor are removed by a cleaner.

In recent years, furthermore, there have been technological advances toward a cleaner-less system, and the foreign matters may be removed with a developing and cleaning system, in which the residual toner is recovered by a cleaning function added to the developing means without using independent cleaning means.

According to this method, charges on the surface of the photosensitive layer are removed by a discharging device after the surface of the photoreceptor is cleaned, and then the electrostatic latent image is eliminated.

An electrophotographic photoreceptor that is used in such an electrophotographic process has a configuration including a photosensitive layer containing a photoconductive material stacked on a conductive substrate made of a conductive material.

As the electrophotographic photoreceptor, photoreceptors formed from an inorganic photoconductive material or an organic photoconductive material (hereinafter, referred to as organic photoconductor, abbreviated as OPC) may be mentioned. Since recent research and development has improved the sensitivity and the durability of organic photoreceptors, the organic photoreceptors are more commonly used today.

In terms of the configuration of the electrophotographic photoreceptors, multilayered photoreceptors have been recently mainstream photoreceptors, in which a photosensitive layer includes functionally-separated layers: a charge generation layer containing a charge generation material and a charge transport layer containing a charge transport material. Most of the photoreceptors are negatively chargeable photoreceptors in which a charge transport layer formed from a charge transport material having a charge transport ability molecularly dispersed in a binder resin is stacked on a charge generation layer formed from a charge generation material vapor-deposited or dispersed in a binder resin. In addition, monolayer photoreceptors have been proposed, in which a charge generation material and a charge transport material are uniformly dispersed or dissolved in the same binder resin.

Furthermore, in order to improve the quality of an image to be printed, an undercoat layer may be provided between the conductive substrate and the photosensitive layer.

Disadvantages of an organic photoreceptor include surface wear caused by slide and brush of a cleaner or the like on the periphery of the photoreceptor due to the nature of organic materials. In order to overcome the disadvantage, an attempt has been made so far to improve mechanical properties of the material of the surface of the photoreceptor.

It has been an important challenge to achieve extended life and higher image quality as desired functions of photoreceptors.

In order to achieve extended life of photoreceptors, it is necessary to improve the wear resistance and ensure the potential stability and the high image quality.

As solutions for achieving extended life, there have been known a method by providing a protective layer to an outermost surface layer of a photoreceptor to give lubricity (for example, Japanese Unexamined Patent Publication No. HEI 1(1989)-23259) and a method by including filler particles in a protective layer (for example, Japanese Unexamined Patent Publication No. HEI 1(1989)-172970). In such methods, it has been considered to add fluorinated particles to the surface as a filler (for example, Japanese Patent No. 3148571 and Japanese Patent No. 3416310). Having a high lubricating function derived from their material, as one of their characteristics, the fluorinated particles as a filler not only improve mechanical properties of the photoreceptor but also reduce the friction between the photoreceptor and a member in contact with the photoreceptor during the process by giving the photoreceptor lubricity. Thus, the fluorine particles contribute to improvement of the printing durability of the surface of the photoreceptor.

Fluorinated fine particles such as, for example, polytetrafluoroethylene (PTFE) particles have an excellent lubricating function as a material. However, the PTFE molecule forming the fine particles does not have polarity, and therefore the fine particles have a very large particle-to-particle attraction force. The fluorinated fine particles are therefore disadvantageous in that they show extremely poor dispersibility in the preparation of a dispersion of the fine particles. Accordingly, it is necessary to use a dispersant when PTFE fine particles are dispersed to be used for a photoreceptor (for example, Japanese Patent No. 3186010). As a result, use of the PTFE fine particles deteriorates electric properties of the photoreceptor.

In addition, as the photoreceptor lives its extended life, the surface (in particular, the charge transport material) of the photoreceptor deteriorates due to the pollution from NOx or ozone gas generated when the photoreceptor is charged, causing a defect in the quality of an image being obtained such as image blurring.

In order to achieve higher image quality in the photoreceptor, a charge transport material having high oxidation resistance and generally having high ionization potential can be selected. In this case, however, charge injection to the charge generation layer and the charge transport layer is difficult, and the sensitivity tends to decrease. Accordingly, use of such a material in combination with the above-described fluorinated fine particles, which are effective for the printing durability improvement, causes further sensitivity reduction in addition to the deterioration of the electric properties of the photoreceptor due to the use of a dispersant.

On the other hand, use of a charge transport material having better responsiveness and electric properties but generally having low ionization potential in combination with the above-described fluorinated fine particles, which are effective for the printing durability improvement, can inhibit the deterioration of the electric properties of the photoreceptor due to the use of a dispersant but causes a defect in the image quality due to the pollution from NOx and ozone gas, because the material has poor oxidation resistance as a charge transport material.

At present, as described above, there has not been found a satisfactory solution to the challenge to achieve both extended life and higher image quality.

SUMMARY OF THE INVENTION

As described above, it is unavoidable to use a dispersant when fluorinated fine particles are added to the surface layer of the photoreceptor, and the addition of a dispersant is accompanied by deterioration of the electric properties of the photoreceptor. Besides, sufficient dispersion stability has not been ensured yet even with the addition of a dispersant.

Accordingly, use of the fluorinated fine particles in combination with a charge transport material having high oxidation resistance and having relatively high ionization potential causes further sensitivity reduction while achieving higher image quality.

On the other hand, use of the fluorinated fine particles in combination with a charge transport material having better responsiveness and electric properties but having relatively low ionization potential for inhibiting deterioration of the electric properties of the photoreceptor due to the use of a dispersant can inhibit the sensitivity reduction but cannot provide high image quality, because the material is vulnerable to damage from oxidized gas and likely to cause an image defect.

At present, therefore, it is impossible to ensure both the extended life and the higher image quality.

It is therefore an object of the present invention to stably ensure excellent wear resistance and properties of an electrophotographic photoreceptor by adding oxygen-containing fluorinated fine particles to a surface of the photoreceptor and to ensure stable production of an electrophotographic photoreceptor including uniformly dispersed oxygen-containing fluorinated fine particles in a surface layer of the photoreceptor by improving the dispersion stability of the fine particles when in the form of a coating solution for photoreceptor formation.

The inventors of the present invention have made intensive studies to achieve the above-described object and, as a result, found that it is possible to provide an electrophotographic photoreceptor which has high dispersion stability when in the form of a coating solution for photoreceptor formation and which has high wear resistance and is electrically stable by including a specific proportion of oxygen-containing fluorinated fine particles obtained by a specific technique in an outermost surface layer of an electrophotographic photoreceptor having a photosensitive layer formed on a conductive substrate. Thus, the inventors have completed the present invention.

According to an aspect of the present invention, there is provided an electrophotographic photoreceptor having a photosensitive layer formed on a conductive substrate, wherein the photosensitive layer contains oxygen-containing fluorinated fine particles in a surface layer thereof, and the oxygen-containing fluorinated fine particles have an oxygen composition ratio of 0.9 to 3.0% by atom based on the whole composition of the fine particles according to an X-ray fluorescence composition analysis.

According to an aspect of the present invention, there is also provided the electrophotographic photoreceptor, wherein the oxygen-containing fluorinated fine particles are obtained by irradiating polytetrafluoroethylene fine particles with gamma radiation from cobalt-60 in the atmosphere or obtained from a tetrafluoroethylene monomer as a raw material by the steps of:

(a) irradiating a mixed solution of the tetrafluoroethylene monomer and acetone with ionizing radiation to polymerize the tetrafluoroethylene monomer so that the mixed solution will be a gel dispersion of polytetrafluoroethylene in acetone;

(b) cross-linking the polytetrafluoroethylene by irradiating the dispersion of the polytetrafluoroethylene in acetone with ionizing radiation to give a suspension of fine particles; and optionally (c) isolating oxygen-containing fluorinated fine particles from the suspension of the fine particles by separation and drying.

According to an aspect of the present invention, there is also provided the electrophotographic photoreceptor, wherein the oxygen-containing fluorinated fine particles have an oxygen composition ratio of 1.0 to 3.0% by atom.

According to an aspect of the present invention, there is also provided the electrophotographic photoreceptor, wherein the oxygen-containing fluorinated fine particles have an oxygen composition ratio of 1.1 to 2.5% by atom.

According to an aspect of the present invention, there is also provided the electrophotographic photoreceptor, wherein the oxygen-containing fluorinated fine particles include primary particles having a median size (D50) of 0.1 to 2 μm.

According to an aspect of the present invention, there is also provided the electrophotographic photoreceptor, wherein the photosensitive layer contains a charge transport material having an ionization potential of 5.25 to 5.70 eV.

According to an aspect of the present invention, there is also provided the electrophotographic photoreceptor, wherein the photosensitive layer contains a charge transport material having an ionization potential of 5.30 to 5.60 eV.

According to an aspect of the present invention, there is also provided the electrophotographic photoreceptor, wherein the photosensitive layer contains 1.0 to 40% by weight of oxygen-containing fluorinated fine particles in the surface layer thereof.

According to another aspect of the present invention, there is provided an image forming apparatus including: the electrophotographic photoreceptor; charge means for charging the electrophotographic photoreceptor; exposure means for exposing the charged electrophotographic photoreceptor to form an electrostatic latent image; developing means for developing the electrostatic latent image with a toner to form a toner image; transfer means for transferring the toner image onto a recording material; and fixing means for fixing the transferred toner image on the recording material.

In the present invention, fluorinated fine particles polymerized by a specific method are included in an outermost layer of an electrophotographic photoreceptor. Thereby, the present invention can provide an electrophotographic photoreceptor which has high dispersion stability when in the form of a coating solution for photoreceptor formation and which has high wear resistance and is electrically stable over a long period of time; and an image forming apparatus including the electrophotographic photoreceptor.

Furthermore, in the present invention, fluorinated fine particles polymerized by a specific method are included in an outermost layer of an electrophotographic photoreceptor, and a charge transport material having an ionization potential in a wide range from 5.25 to 5.70 eV, that is, from an ionization potential conventionally considered to be relatively low to a high ionization potential. Thereby, the present invention can provide an excellent electrophotographic photoreceptor which has improved dispersion stability when in the form of a coating solution for photoreceptor formation and therefore has a photosensitive layer in which a filler and the charge transport material are uniformly dispersed, and which has high wear resistance, and stable and high electric properties and image quality.

DETAILED DESCRIPTION OF THE PREFERRED EMBODIMENTS

Figure 1:
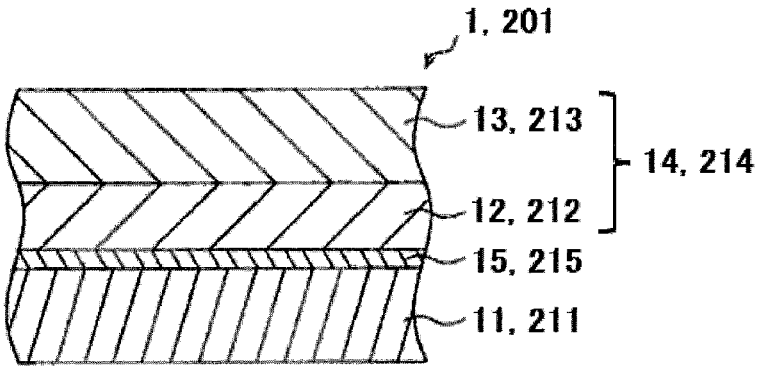
FIG. 1 is a schematic sectional view showing a configuration of an electrophotographic photoreceptor according to Embodiment 1 of the present invention.

An electrophotographic photoreceptor of the present invention has a photosensitive layer provided on a conductive substrate, and an outermost layer of the photosensitive layer contains a specific amount of oxygen-containing fluorinated fine particles.

An electrophotographic photoreceptor of the present invention has a photosensitive layer formed on a conductive substrate, and an outermost layer of the photosensitive layer contains fluorinated fine particles containing a specific amount of oxygen and a charge transport material having an ionization potential in a wide range from 5.25 to 5.70 eV, that is, from an ionization potential conventionally considered to be relatively low to a high ionization potential.

The photoreceptor of the present invention can be applied to either a monolayer photoreceptor or a multilayered photoreceptor. The photoreceptor of the present invention may have a charge transport layer as the outermost layer or may be further provided with a protective layer as the outermost layer. The photoreceptor of the present invention can be more electrically stable with the use of an undercoat layer (may be referred to as interlayer).

The fluorinated fine particles used in the embodiments of the present invention have a specific oxygen composition ratio. That is, the fine particles have an oxygen composition ratio of preferably 0.9 to 3.0% by atom (hereinafter, may be simply presented by %), more preferably 1.0 to 3.0% by atom, and still more preferably 1.1 to 2.5% by atom based on the whole composition of the fine particles according to an X-ray fluorescence composition analysis.

In order to have the oxygen composition ratio within the desired range, it is essential to change the structure of the fluorinated fine particles with radiation. Preferably, the fluorinated fine particles are irradiated with gamma radiation. Specifically, the fluorinated fine particles, in particular, polytetrafluoroethylene (PTFE) fine particles are irradiated with varied doses of gamma radiation to have a desired oxygen composition ratio.

It is assumed that the gamma-irradiated PTFE fine particles take in oxygen from oxygen or carbon dioxide in the air therearound, or oxygen derived from the solvent used therefor to be oxygen-containing fluorinated fine particles (may be referred to as oxygen-containing cross-linked polytetrafluoroethylene (PTFE)) as described in the examples given below, although details have not been revealed.

Alternatively, such oxygen introduction can be achieved also by electron beam irradiation.

More preferably, the oxygen-containing fluorinated fine particles in the present invention are obtained by irradiating polytetrafluoroethylene fine particles with gamma radiation from cobalt-60 in the atmosphere or obtained from a tetrafluoroethylene monomer as a raw material by the steps of:

(a) irradiating a mixed solution of the tetrafluoroethylene monomer and acetone with ionizing radiation to polymerize the tetrafluoroethylene monomer so that the mixed solution will be a gel dispersion of polytetrafluoroethylene in acetone;

(b) cross-linking the polytetrafluoroethylene by irradiating the dispersion with ionizing radiation to give a suspension of fine particles; and optionally (c) isolating oxygen-containing fluorinated fine particles from the suspension of the fine particles by separation and drying. That is, preferably, the oxygen-containing fluorinated fine particles in the present invention are derived from the above-mentioned suspension of fine particles or the above-mentioned isolated oxygen-containing fluorinated fine particles.

An image forming apparatus of the present invention includes: the above-described electrophotographic photoreceptor; charge means for charging the electrophotographic photoreceptor; exposure means for exposing the charged electrophotographic photoreceptor to form an electrostatic latent image; developing means for developing the electrostatic latent image with a toner to form a toner image; transfer means for transferring the toner image onto a recording material; and fixing means for fixing the transferred toner image on the recording material. The image forming apparatus may further include cleaning means for removing and recovering toner left on the electrophotographic photoreceptor and discharge means for removing charges remaining on the surface of the electrophotographic photoreceptor. An image forming apparatus of the present invention may have a configuration including the above-described electrophotographic photoreceptor, charge means, exposure means, developing means and transfer means.

Hereinafter, embodiments and examples of the present invention will be described in detail with reference to FIGS. 1 to 5. It should be noted that the following embodiments and examples are merely concrete examples of the present invention and the present invention is not limited thereto.

Embodiment 1

FIG. 1 is a schematic sectional view showing a configuration of an electrophotographic photoreceptor according to Embodiment 1 of the present invention. An electrophotographic photoreceptor 1, 201 according to Embodiment 1 (hereinafter, abbreviated as "photoreceptor") is a multilayered photoreceptor including, in sequence, a cylindrical conductive substrate 11, 211 formed of a conductive material; an undercoat layer 15, 215; and a photosensitive layer 14, 214 including a charge generation layer 12, 212 containing a charge generation material and a charge transport layer 13, 213 containing a charge transport material stacked in this order.

Conductive Substrate (Hereinafter, May be Referred to as "Conductive Support")

The conductive substrate 11, 211 plays a role as an electrode of the photoreceptor 1 and functions as a supporting member for the layers disposed thereon, that is, the undercoat layer 15, 215 and the photosensitive layer 14, 214.

While the conductive substrate 11, 211 has a cylindrical shape in Embodiment 1, the shape of the conductive substrate 11, 211 is not limited thereto and may be columnar, sheet-like or endless-belt-like.

Examples of the conductive material usable for forming the conductive substrate 11, 211 include conductive metals such as aluminum, copper, brass, zinc, nickel, stainless steel, chromium, molybdenum, vanadium, indium, titanium, gold and platinum; alloys such as aluminum alloys; and metal oxides such as tin oxide and indium oxide.

The conductive material is not limited to these metallic materials, and may be also used materials obtained by laminating foil of the above-mentioned metals, vapor-depositing the above-mentioned metallic materials, or vapor-depositing or applying a layer of a conductive compound such as conductive polymer, tin oxide and indium oxide on a surface of a polymeric material such as polyethylene terephthalate, nylon, polyester, polyoxymethylene and polystyrene, or on hard paper, glass, or the like.

These conductive materials are processed into a predetermined shape for use.

As needed, a surface of the conductive substrate 11 may be processed by anodic oxidation coating treatment, surface treatment using chemicals or hot water, coloring treatment, or irregular reflection treatment such as surface roughing to the extent that the image quality is not adversely affected.

Since laser light has a uniform wavelength in an electrophotographic process with the use of a laser as an exposure light source, laser light reflected on the surface of the photoreceptor may interfere with the laser light reflected on the inside of the photoreceptor, resulting in appearance of interference fringes on an image and generation of an image defect.

However, such an image defect due to the interference by the laser light having a uniform wavelength can be prevented by giving the surface of the conductive substrate 11, 211 the above-mentioned treatments.

Undercoat Layer (Hereinafter, May be Referred to as "Interlayer")

Without the undercoat layer 15, 215 between the conductive substrate 11, 211 and the photosensitive layer 14, 214, a defect in the conductive substrate 11, 211 or the photosensitive layer 14, 214 may reduce the chargeability in micro areas, and thus image fogging such as black dots may be generated, leading to a significant image defect. With the undercoat layer, it is possible to prevent charge injection from the conductive substrate 11, 211 to the photosensitive layer 14, 214.

With the undercoat layer 15, 215, therefore, reduction in the chargeability of the photosensitive layer 14, 214 can be prevented, and reduction in surface charges in areas other than those where surface charges should be eliminated by light exposure can be suppressed, preventing generation of a defect such as image fogging.

With the undercoat layer 15, 215, furthermore, unevenness in the surface of the conductive substrate 11, 211 can be covered to give an even surface. Accordingly, the film formation for the photosensitive layer 14, 214 is facilitated, separation of the photosensitive layer 14, 214 from the conductive substrate 11, 211 can be inhibited, and the adhesion between the conductive substrate 11, 211 and the photosensitive layer 14, 214 can be improved.

A resin layer of a variety of resin materials or an alumite layer may be used for the undercoat layer 15, 215.

Examples of the resin materials for forming the resin layer as the undercoat layer 15, 215 include resins such as polyethylene resins, polypropylene resins, polystyrene resins, acrylic resins, polyvinyl chloride resins, polyvinyl acetate resins, polyurethane resins, epoxy resins, polyester resins, melamine resins, silicone resins, polyvinyl butyral resins, polyvinyl pyrrolidone resins, polyacrylamide resins and polyamide resins; and copolymer resins including two or more of the repeat units that form the above-mentioned resins. In addition, may be mentioned casein, gelatin, polyvinyl alcohol, cellulose, nitrocellulose and ethyl cellulose.

Of these resins, polyamide resins are preferably used, and alcohol-soluble nylon resins are particularly preferably used.

Examples of the preferable alcohol-soluble nylon resins include so-called nylons such as 6-nylon, 6,6-nylon, 6,10-nylon, 11-nylon, 2-nylon and 12-nylon; and resins obtained by chemically modifying nylon such as N-alkoxymethyl-modified nylon and N-alkoxyethyl-modified nylon.

In order to give the undercoat layer a charge controlling function, metal oxide fine particles are added as a filler. Examples of the filler include particles of titanium oxide, aluminum oxide, aluminum hydroxide and tin oxide. The metal oxide appropriately has a particle diameter of approximately 0.01 to 0.3 μm. Preferably, the particle diameter is approximately 0.02 to 0.1 μm.

The undercoat layer 15, 215 can be formed, for example, by dissolving or dispersing the above-mentioned resin in an appropriate solvent to prepare a coating solution for undercoat layer formation and applying the coating solution onto the surface of the conductive substrate 11.

For forming the undercoat layer 15, 215 containing particles such as the metal oxide fine particles, for example, fine particles of a metal oxide such as titanium oxide are dispersed in the resin solution obtained by dissolving the resin in the appropriate solvent to prepare the coating solution for undercoat layer formation and the coating solution is applied onto the surface of the conductive substrate 11, 211.

As the solvent for the coating solution for undercoat layer formation, water, various organic solvents, and mixture thereof may be used. For example, may be used a single solvent of water, or an alcohol such as methanol, ethanol or butanol; or a mixed solvent of water and an alcohol, two or more kinds of alcohols, acetone or dioxolane and an alcohol, a halogen-based organic solvent such as dichloroethane, chloroform or trichloroethane and an alcohol.

Of these solvents, non-halogen organic solvents are preferably used in terms of global environmental consideration.

The metal oxide fine particles can be dispersed in the resin solution by any common dispersion method such as those with the use of a ball mill, a sand mill, an attritor, an oscillation mill, an ultrasonic disperser or a paint shaker.

A more stable coating solution can be prepared by using a media-less disperser that uses a very strong shear force to be generated by passing the fluid dispersion through micro voids under ultra high pressure.

Examples of the method of applying the coating solution for undercoat layer formation include a spraying method, a bar coating method, a roll coating method, a blade method, a ring method and a dipping coating method.

Of the coating methods, in particular, the dipping coating method is relatively simple and advantageous in terms of productivity and costs, and therefore often used for the production of electrophotographic photoreceptors. In the dipping coating method, the substrate is dipped in a coating vessel filled with the coating solution, and then raised at a constant rate or at a rate that changes successively to form a layer on the surface of the substrate. The apparatus to be used for the dipping coating method may be provided with a coating solution dispersing machine typified by ultrasonic generators in order to stabilize the dispersibility of the coating solution.

The undercoat layer 15, 215 has a film thickness of preferably 0.01 μm to 20 μm, and more preferably 0.05 μm to 10 μm.

It is not preferable that the undercoat layer 15, 215 has a film thickness of less than 0.01 μm, because in this case, the resulting layer does not substantially function as the undercoat layer 15, 215 as failing to cover unevenness in the conductive substrate 11, 211 to give an even surface and failing to prevent charge injection from the conductive substrate 11, 211 to the photosensitive layer 14, 214, and thus the chargeability of the photosensitive layer 14, 214 is reduced.

It is not preferable either that the undercoat layer 15, 215 has a film thickness of more than 20 μm, because in this case, it is difficult to form the undercoat layer 15, 215 by the dipping coating method and it is impossible to uniformly form the photosensitive layer 14, 214 on the undercoat layer 15, 215, and thus the sensitivity of the photoreceptor is reduced.

Accordingly, the suitable range of the film thickness of the undercoat layer 15, 215 is 0.01 to 20 μm.

Charge Generation Layer

The charge generation layer 12, 212 contains, as a main component, a charge generation material that absorbs light to generate charges.

Examples of the charge generation material include organic photoconductive materials including organic pigments and inorganic photoconductive materials including inorganic pigments.

Examples of the organic photoconductive materials include azo pigments such as monoazo pigments, bisazo pigments and trisazo pigments; indigoid pigments such as indigo and thioindigo; perylene pigments such as perylenimide and perylenic anhydride; polycyclic quinone pigments such as anthraquinone and pyrenequinone; phthalocyanine pigments such as metal phthalocyanines and metal-free phthalocyanines; squarylium dyes; pyrylium and thiopyrylium salts; and triphenylmethane dyes.

Examples of the inorganic photoconductive materials include selenium and alloys thereof, arsenic-selenium, cadmium sulfide, zinc oxide, amorphous silicon and other inorganic photoconductors.

The charge generation material may be used in combination with a sensitizing dye. Examples of the sensitizing dye include triphenylmethane type dyes such as Methyl Violet, Crystal Violet, Night Blue, and Victoria Blue; acridine dyes such as Erythrocin, Rhodamine B, Rhodamine 3R, Acridine Orange, and Flapeocine; thiazine dyes such as Methylene Blue and Methylene Green; oxazine dyes such as Capri Blue and Meldola's Blue; cyanine dyes; styryl dyes; pyrylium salt dyes; and thiopyrylium salt dyes.

Examples of the method of forming the charge generation layer 12, 212 include a method by vacuum deposition of the charge generation material on the surface of the conductive substrate 11, 211 and a method by applying, to the surface of the conductive substrate 11, the coating solution for charge generation layer formation obtained by dispersing the charge generation material in an appropriate solvent.

Of these methods, a method is suitably used in which a coating solution for charge generation layer formation is prepared by dispersing the charge generation material in a binder resin solution obtained by dissolving the binder resin as a binding agent in a solvent by a conventionally known method, and the resulting coating solution is applied to the surface of the conductive substrate 11, 211. Hereinafter, this method will be described.

Examples of the binder resin to be used for the charge generation layer 12, 212 include resins such as polyester resins, polystyrene resins, polyurethane resins, phenol resins, alkyd resins, melamine resins, epoxy resins, silicone resins, acrylic resins, methacrylic resins, polycarbonate resins, polyarylate resins, phenoxy resins, polyvinyl butyral resins, polyvinyl chloride resins and polyvinyl formal resins; and copolymer resins including at least two of the repeat units that form the above-mentioned resins.

Specific examples of the copolymer resins include insulating resins such as vinyl chloride-vinyl acetate copolymer resins, vinyl chloride-vinyl acetate-maleic anhydride copolymer resins and acrylonitrile-styrene copolymer resins.

The binder resin is not limited to the above-mentioned resins, and any commonly used resin may be used as the binder resin. These resins may be used independently, or two or more kinds may be used in combination.

Examples of the solvent that may be used for the coating solution for charge generation layer formation include halogenated hydrocarbons such as dichloromethane and dichloroethane; alcohols such as methanol and ethanol; ketones such as acetone, methyl ethyl ketone and cyclohexanone; esters such as ethyl acetate and butyl acetate; ethers such as tetrahydrofuran and dioxane; alkyl ethers of ethylene glycol such as 1,2-dimethoxyethane; aromatic hydrocarbons such as benzene, toluene and xylene; and aprotic polar solvents such as N,N-dimethylformamide and N,N-dimethylacetamide.

Of these solvents, non-halogen organic solvents are preferably used in terms of global environmental consideration. The above-mentioned solvents may be used independently, or two or more kinds may be used in combination.

In the charge generation layer 12 including the charge generation material and the binder resin, the ratio W1/W2 between the weight W1 of the charge generation material and the weight W2 of the binder resin is preferably 10/100 to 400/100. If the ratio W1/W2 is lower than 10/100, the sensitivity of the photoreceptor 1 is easily reduced.

If the ratio W1/W2 is higher than 400/100, on the other hand, not only is the film strength of the charge generation layer 12, 212 reduced but the dispersibility of the charge generation material is also reduced, increasing coarse particles. As a result, surface charges in areas other than those where surface charges should be eliminated by light exposure are reduced, and an image defect, in particular, image fogging called black dots formed as small black spots made of a toner on a white background area increases.

Accordingly, the suitable range of the ratio W1/W2 is 10/100 to 400/100.

The charge generation material may be preliminarily milled with a milling machine before being dispersed in the binder resin solution.

Examples of the milling machine to be used for the milling include a ball mill, a sand mill, an attritor, an oscillation mill and an ultrasonic dispersing machine.

Examples of the dispersing machine to be used for dispersing the charge generation material in the binder resin solution include a paint shaker, a ball mill and a sand mill. On this occasion, dispersion conditions are set as appropriate so as to prevent contamination of the solution with impurities generated due to abrasion or the like of members forming the container and the dispersing machine to use.

Examples of the method of applying the coating solution for charge generation layer formation include a spraying method, a bar coating method, a roll coating method, a blade method, a ring method and a dipping coating method.

An optimal method can be selected from the above-mentioned coating methods in consideration of the physical properties of the coating solution and the productivity.

Of these coating methods, the dipping coating method described as the coating method for the undercoat layer is particularly preferable.

The charge generation layer 12, 212 has a film thickness of preferably 0.05 μm to 5 μm, and more preferably 0.1 μm to 1 μm.

If the charge generation layer 12, 212 has a film thickness of less than 0.05 μm, the efficiency of the charge generation by light absorption is reduced, and the sensitivity of the photoreceptor 1, 201 is reduced.

If the charge generation layer 12, 212 has a film thickness of more than 5 μm, on the other hand, the light absorption efficiency is reduced, and charge transport is caused within the charge generation layer 12, 212 to be a rate-determining step in a process of eliminating surface charges of the photosensitive layer 14, 214, reducing the sensitivity of the photoreceptor 1, 201.

Accordingly, the suitable range of the film thickness of the charge generation layer 12, 212 is 0.05 μm to 5 μm.

Charge Transport Layer

The charge transport layer 13, 213 is provided on the charge generation layer 12, 212. The charge transport layer 13, 213 includes a charge transport material that receives and transports charges generated by the charge generation material included in the charge generation layer 12, 212, and a binder resin that binds the charge transport material.

Examples of the charge transport material include enamine derivatives, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives and benzidine derivatives.

As the binder resin forming the charge transport layer 13, a resin containing a polycarbonate commonly known in the art as a main component is suitably selected since it has higher transparency and printing durability.

The resin may further contain a second component. Examples of the second component include vinyl polymer resins such as polymethyl methacrylate resins, polystyrene resins and polyvinyl chloride resins, and copolymers including two or more of the repeat units that form the above-mentioned resins; and polyester resins, polyester carbonate resins, polysulfone resins, phenoxy resins, epoxy resins, silicone resins, polyarylate resins, polyamide resins, polyether resins, polyurethane resins, polyacrylamide resins and phenolic resins as well as thermosetting resins that are obtained by partially cross-linking the above-mentioned resins. These resins may be used independently, or two or more kinds may be used in combination.

The term "main component" means that the percentage by weight of the polycarbonate resin accounts for the greatest proportion, preferably, 50 to 90% by weight, of the binder resin as a whole forming the charge transport layer.

The resin as the second component is used in a proportion in a range from 10 to 50% by weight of the binder resin as a whole.

Preferably, the weight ratio between the charge transport material and the binder resin in the charge transport layer is 10/10 to 10/18.

In the case where the charge transport layer 13, 213 is the outermost layer of the photoreceptor, filler particles may be added for the purpose of improving the wear resistance and the like of the charge transport layer.

The filler particles are roughly classified into organic filler particles and inorganic filler particles including metal oxides.

From the viewpoint of mechanical properties for the improvement in wear resistance of the charge transport layer 13, use of a metal oxide having relatively high hardness as the filler particles is often advantageous.

However, the filler particles to be added to the charge transport layer 13 need to meet the requirements described below; for example, the filler particles should not deteriorate electric properties of the charge transport layer 13, 213.

That is, use of filler particles having a significantly larger relative dielectric constant (for example, $\in r>10$) in the charge transport layer 13, 213 than an average relative dielectric constant ($\in r$)≈3 of the organic photoreceptor can result in nonuniform dielectric constant throughout the charge transport layer 13 and have a negative effect on the electric properties of the charge transport layer.

Accordingly, filler particles having a relatively small relative dielectric constant can be used for the charge transport layer more suitably without having a negative effect on the electric properties of the charge transport layer.

As the filler particles to be added to the charge transport layer 13, 213, therefore, organic filler particles are more advantageous than metal oxides generally having a higher relative dielectric constant When the filler is aimed at imparting lubricity to the outermost layer of the photoreceptor, fluorine fine particles may be advantageously selected.

Preferably, filler particles having a smaller diameter is used in order to reduce light scattering and negative effects on electric carriers in the charge transport layer 13, 213 as much as possible. Specifically, filler particles whose primary particles have a median size (D50) of 0.1 to 2 μm are preferable from the viewpoint of the dispersion stability of the coating solution including the filler particles.

The filler particles are added in an amount of 1 to 40% by weight, and preferably 1.5 to 35% by weight with respect to the total weight of the charge transport material and the binder resin (solid content of the charge transport layer).

If the amount of the filler particles is less than 1% by weight, the particles do not function as a filler, failing to improve the printing durability.

If the amount of the filler is more than 40% by weight, on the other hand, the addition of the insulative filler fine particles have a negative effect of deteriorating the electric properties of the photoreceptor, and therefore a sufficient image density cannot be obtained and an image defect is generated, posing problems in practical use.

As in the case of the oxide fine particles to be added to the undercoat layer, the filler particles can be dispersed by a common method such as those with the use of a ball mill, a sand mill, an attritor, an oscillation mill, an ultrasonic disperser and a paint shaker.

A more stable coating solution can be prepared by using a media-less disperser that uses a very strong shear force to be generated by passing the fluid dispersion through micro voids under ultra high pressure.

In addition, various additives may be added to the charge transport layer 13, 213 as needed. Specifically, a plasticizer and a leveling agent may be added to the charge transport layer 13, 213 in order to improve the film formation ability, the flexibility and the surface smoothness.

Examples of the plasticizer include dibasic acid esters such as phthalate esters, fatty acid esters, phosphoric esters, chlorinated paraffins and epoxy type plasticizers. Examples of the leveling agent include silicone-based leveling agents.

As in the case of the formation of the charge generation layer 12 by a coating method, the charge transport layer 13, 213 is formed by dissolving or dispersing the charge transport material, the binder resin, the filler particles and the additives as needed in an appropriate solvent to prepare a coating solution for charge transport layer formation, and applying the resulting coating solution onto the charge generation layer 12, 212, for example.

Examples of the solvent of the coating solution for charge transport layer formation include aromatic hydrocarbons such as benzene, toluene, xylene and monochlorobenzene; halogenated hydrocarbons such as dichloromethane and dichloroethane; ethers such as tetrahydrofuran, dioxane and dimethoxymethyl ether; and aprotic polar solvents such as N,N-dimethylformamide. These solvents may be used independently, or two or more kinds may be used in combination.

As needed, a solvent such as an alcohol, acetonitrile and methyl ethyl ketone may be further added to the solvent.

Of these solvents, non-halogen organic solvents are preferably used in terms of global environmental consideration.

Examples of the method of applying the coating solution for charge transport layer formation include a spraying method, a bar coating method, a roll coating method, a blade method, a ring method and a dipping coating method. Of these coating methods, in particular, the dipping coating method is usable also for the formation of the charge transport layer 13, 213, because it is advantageous in various points as described above.

The charge transport layer 13, 213 has a film thickness of preferably 5 μm to 40 μm, and more preferably 10 μm to 30 μm.

It is not preferable that the charge transport layer 13, 213 has a film thickness of less than 5 μm, because in this case, the charge retention ability thereof is reduced, and it is difficult to obtain clear images.

If the charge transport layer 13, 213 has a film thickness of more than 40 μm, on the other hand, the resolution of the photoreceptor 1, 201 is reduced.

Accordingly, the suitable range of the film thickness of the charge transport layer 13, 213 is 5 μm to 40 μm.

In order to improve the sensitivity and inhibit increase in residual potential and fatigue due to repeated use, one or more kinds of sensitizers such as electron acceptor substances and dyes may be added to each layer of the photosensitive layer 14, 214.

Examples of the electron acceptor substances include electron attractive materials such as acid anhydrides including succinic anhydride, maleic anhydride, phthalic anhydride and 4-chloronaphthalic acid anhydride; cyano compounds including tetracyanoethylene and terephthalmalondinitrile; aldehydes including 4-nitrobenzaldehyde; anthraquinones including anthraquinone and 1-nitroanthraquinone; polycyclic or heterocyclic nitro compounds including 2,4,7-trinitrofluorenone and 2,4,5,7-tetranitrofluorenone; and diphenoquinone compounds. In addition, may be used materials obtained by polymerizing these electron attractive materials.

Examples of the dyes include xanthene-based dyes, thiazine dyes, triphenylmethane dyes, quinoline-based pigments and organic photoconductive compounds such as copper phthalocyanine.

These organic photoconductive compounds function as an optical sensitizer.

Furthermore, an antioxidant or an ultraviolet absorber may be added to each of the layers 12, 212 and 13, 213 of the photosensitive layer 14, 214. In particular, it is preferable to add an antioxidant, an ultraviolet absorber, or the like to the charge transport layer 13, 213. The addition of an antioxidant or an ultraviolet absorber enhances the stability of the coating solution for forming each layer by a coating method. It is particularly preferable to add an antioxidant to the charge transport layer 13, 213. The addition of an antioxidant to the charge transport layer reduces deterioration of the photosensitive layer due to oxidized gases such as ozone and nitrogen oxides.

Examples of the antioxidant include phenol compounds, hydroquinone compounds, tocopherol compounds and amine compounds. Of these antioxidants, hindered phenol derivatives or hindered amine derivatives, or mixtures thereof are suitably used.

In some cases, a surface protective layer may be provided as needed.

Embodiment 2

Figure 2:
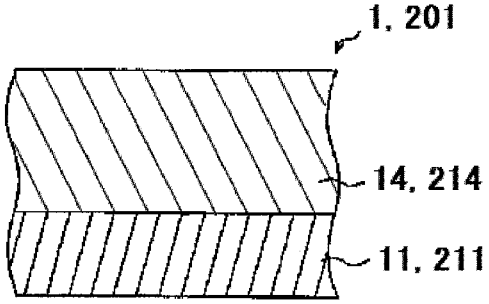
FIG. 2 is a schematic sectional view showing a configuration of an electrophotographic photoreceptor according to Embodiment 2 of the present invention.

As Embodiment 1, an embodiment has been described in which the photosensitive layer 14, 214 is a multilayered photosensitive layer including the charge generation layer 12, 212 and the charge transport layer 13, 213. In another embodiment, however, the photosensitive layer 14, 214 may be a single layer, that is, a monolayer photosensitive layer as shown in FIG. 2.

Specifically, the photoreceptor 1, 201 may be formed from the cylindrical conductive substrate 11, 211 made of a conductive material, and a photosensitive layer 14, 214 which is a layer stacked on an outer circumferential surface of the conductive substrate 11, 211 and which contains a charge generation material and a charge transport material.

Embodiment 3

Figure 3:
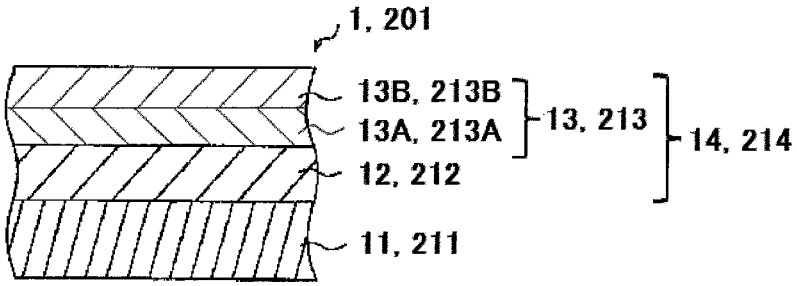
FIG. 3 is a schematic sectional view showing a configuration of an electrophotographic photoreceptor according to Embodiment 3 of the present invention.

In another embodiment, the charge transport layer 13, 213 may be formed from a plurality of layers as shown in FIG. 3.

In the present embodiment, specifically, the charge transport layer is formed from two different charge transport layers 13A (213A) and 13B, 213B stacked one on top of the other, and oxygen-containing fluorinated fine particles are added to the charge transport layer 13B, 213B constituting the outermost surface. That is, FIG. 3 shows an embodiment in which the charge transport layer 13, 213 is formed from the first charge transport layer 13A, 213A and the second charge transport layer 13B, 213B, the first charge transport layer 13A, 213A and the second charge transport layer 13B, 213B have different charge transport material contents, and the second charge transport layer 13B, 213B contains filler particles.

When the charge transport layer 13, 213 is formed from a plurality of layers stacked one on top of the other as described above, filler particles are preferably contained in the surface-side layer of the charge transport layer 13, 213.

Embodiment 4

Figure 4:
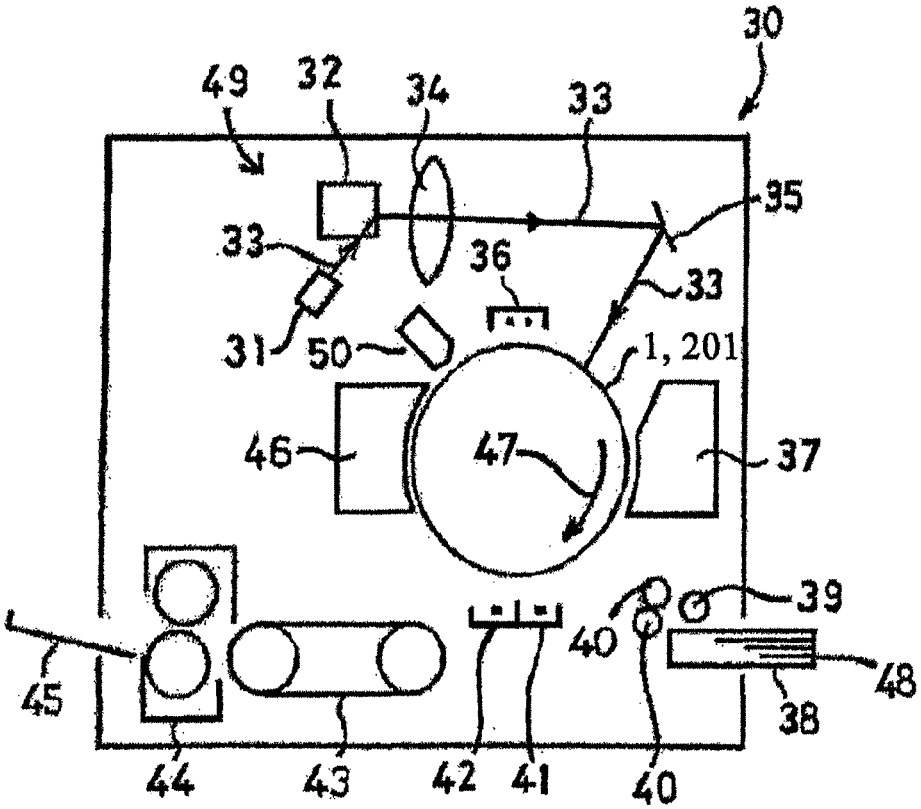
FIG. 4 is a schematic side sectional view showing a configuration of an image forming apparatus according to Embodiment 4 of the present invention.

FIG. 4 is a schematic side sectional view showing a configuration of an image forming apparatus of the present invention.

An image forming apparatus 30 shown in FIG. 4 is a laser printer including the photoreceptor 1, 201 of Embodiment 1 of the present invention.

Hereinafter, the configuration and an image forming operation of the laser printer 30 will be described with reference to FIG. 4.

It should be noted that the laser printer 30 shown in FIG. 4 is an example of the present invention, and the following description is not intended to limit the image forming apparatus of the present invention.

The laser printer 30 as an image forming apparatus includes the photoreceptor 1, 201, a semiconductor laser 31, a rotary polygon mirror 32, an imaging lens 34, a mirror 35, a corona charger 36 as charge means, a developing device 37 as developing means, a transfer sheet cassette 38, a sheet feed roller 39, registration rollers 40, a transfer charger 41 as transfer means, a separation charger 42, a conveyance belt 43, a fixing device 44, a sheet discharge tray 45 and a cleaner 46 as cleaning means.

The semiconductor laser 31, the rotary polygon mirror 32, the imaging lens 34 and the mirror 35 form exposure means 49.

The photoreceptor 1, 201 is mounted in the laser printer 30 in such a manner that it can be rotated in a direction of an arrow 47 by driving means, not shown. A laser beam 33 emitted from the semiconductor laser 31 is scanned repeatedly in the longitudinal direction (major scanning direction) of a surface of the photoreceptor 1 by the rotary polygon mirror 32. The imaging lens 34 has an f-θ characteristic, and causes the laser beam 33 to be reflected on the mirror 35 to expose the surface of the photoreceptor 1 while imaging the laser beam thereon. The laser beam 33 is scanned and imaged as described above while the photoreceptor 1 is rotated, thereby forming an electrostatic latent image according to image information on the surface of the photoreceptor 1.

The corona charger 36, the developing device 37, the transfer charger 41, the separation charger 42 and the cleaner 46 are disposed in this order from the upstream side to the downstream side in the rotation direction represented by the arrow 47 of the photoreceptor 1.

The corona charger 36 is disposed on the upstream side of an imaging point of the laser beam 33 in the rotation direction of the photoreceptor 1, 201 to uniformly charge the surface of the photoreceptor 1. Accordingly, the uniformly charged surface of the photoreceptor 1 will be exposed to the laser beam 33, generating a difference between the charge amount of an area exposed to the laser beam 33 and the charge amount of an area not exposed to the laser beam 33. Thus, the above-mentioned electrostatic latent image is formed.

The developing device 37 is disposed on the downstream side of the imaging point of the laser beam 33 in the rotation direction of the photoreceptor 1, 201 and supplies a toner to the electrostatic latent image formed on the surface of the photoreceptor 1 to develop the electrostatic latent image into a toner image. Transfer sheets 48 contained in the transfer sheet cassette 38 are taken out one by one by the sheet feed roller 39 and provided to the transfer charger 41 by the registration rollers 40 in synchronization with the exposure of the photoreceptor 1. The toner image is transferred to each transfer sheet 48 by the transfer charger 41. The separation charger 42 disposed in the vicinity of the transfer charger 41 removes charges from the transfer sheet to which the toner image has been transferred to separate the sheet from the photoreceptor 1.

The transfer sheet 48 separated from the photoreceptor 1, 201 is conveyed to the fixing device 44 by the conveyance belt 43, and the toner image is fixed on the transfer sheet 48 by the fixing device 44. The transfer paper 48 on which an image has been thus formed is discharged to the sheet discharge tray 45. After the transfer sheet 48 is separated by the separation charger 42, the photoreceptor 1 keeps on rotating, while toner and foreign substances such as paper particles left on the surface of the photoreceptor 1 are cleaned by the cleaner 46. The charges of the photoreceptor 1 the surface of which has been cleaned by the cleaner 46 are removed by a discharger (discharge lamp) 50 provided besides the cleaner 46, and then the photoreceptor 1 is further rotated, and a series of image formation operations starting from the charging of the photoreceptor 1, 201 is repeated.

Thus, the present invention provides an image forming apparatus including an electrophotographic photoreceptor of the present invention, charge means, exposure means, developing means and transfer means.

Embodiment 5

Description of Image Forming Apparatus

Here, an image forming apparatus including a photoreceptor drum 3 formed of the photoreceptor 201 according to any of Embodiments 1 to 3 of the present invention will be described.

Figure 5:
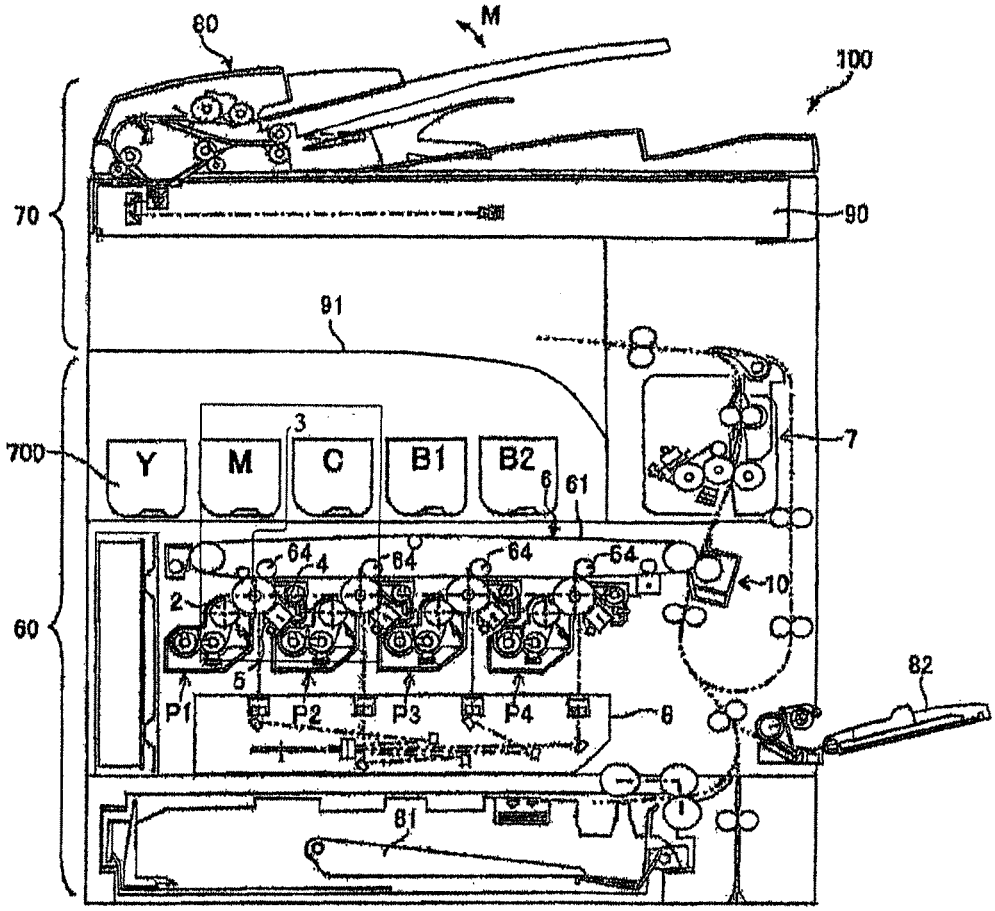
FIG. 5 is a schematic side sectional view showing a configuration of an image forming apparatus according to Embodiment 5 of the present invention.
Figure 6:
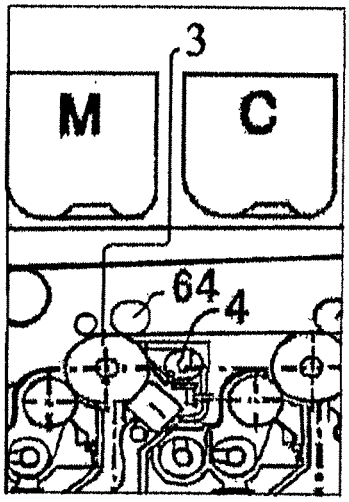
FIG. 6 is an enlarged view of a portion of the image forming apparatus of FIG. 5.

FIG. 5 is a schematic side sectional view showing an example of a schematic structure of the image forming apparatus. As shown in FIG. 5, the image forming apparatus 100 includes an image forming unit 60 and a document reading unit 70.

The document reading unit 70 mainly has an automatic document feeder 80 and a scanning section 90. A plurality of document sheets placed on a document table of the automatic document feeder 80 are sequentially fed to an upper part of the scanning section 90 where each document is read.

The image forming unit 60 includes four image formation stations P1, P2, P3 and P4 corresponding to yellow (Y), cyan (C), magenta (M) and black (B), respectively. The four image formation stations P1 to P4 basically have the same configuration including the photoreceptor drum 3, and a charger 5, a developing device 2, a transfer roller 64, a cleaner unit 4 and so on arranged around the photoreceptor drum 3. Each image formation station P is given individual identification information so that a control section can separately distinguish the image formation stations P.

An exposure unit 8 is disposed under the image formation stations P1 to P4, and an intermediate transfer belt mechanism 6 is disposed above the image formation stations P1 to P4. According to image data, the exposure unit 8 exposes the surface of each photoreceptor drum 3 charged by the charging device 5 to thereby form an electrostatic latent image on the surface of each photoreceptor drum 3, and the developing device 2 supplies a toner to the electrostatic latent image to thereby develop the electrostatic latent image into a toner image. The toner images formed on the surfaces of the photoreceptor drums 103 are transferred to and superimposed on an intermediate transfer belt 61 wound around transfer rollers 64 of the image formation stations P1 to P4 by the intermediate transfer belt mechanism 6.

A transfer device 10 is provided ahead of a direction of the travel of the intermediate transfer belt 61 in the intermediate transfer belt mechanism 6, and the transfer device 10 transfers the toner images on the intermediate transfer belt 61 onto a paper sheet (sheet material) fed from a sheet feed cassette 81 or a manual sheet feed cassette 82. Furthermore, a fixing device 7 is provided ahead of a sheet conveyance direction, and the toner images are solidified and fixed on the paper sheet while passing through the fixing device 7, and then the paper sheet is discharged onto a sheet discharge tray 91.

The image forming unit 60 further includes toner supplying devices 700 for supplying toners to the respective developing devices 2 of the four image formation stations P1 to P4. In the configuration shown in FIG. 4, the image forming unit 60 includes five toner supplying devices 700 for colors of black (B1 and B2), cyan (C), magenta (M) and yellow (Y).

The image forming apparatus of the present invention is not limited to the configuration of the image forming apparatus shown in FIGS. 4 and 5, and can be various types of printers, copying machines, facsimile machines and multifunctional systems, monochrome or color imaging, that use an electrophotographic process as long as they can include the photoreceptor of the present invention.

It should be noted that the image forming apparatus of the present invention is not limited to the embodiments described above, and various modifications and adaptations may be made thereto without departing from the spirit of the present invention, and other embodiments will be readily understood from the description in the specification and the drawings.

EXAMPLES

Hereinafter, the present invention will be further described by the following examples which are illustrative only and do not limit the present invention.

Example 1A

Preparation of Interlayer

To 25 parts by weight of methyl alcohol, 3 parts by weight of titanium oxide (trade name: TIPAQUE TTO-D-1, available from Ishihara Sangyo Kaisha, Ltd.) and 2 parts by weight of a commercial polyamide resin (trade name: Amilan CM8000, available from Toray Industries, Inc.) were added and dispersed with a paint shaker for 8 hours to give 3 kg of a coating solution for interlayer formation. A drum-like aluminum support having a diameter of 30 mm and a length of 357 mm as a conductive support was dipped in a coating vessel filled with the coating solution for interlayer formation obtained, and then raised to form an interlayer having a film thickness of 1 μm.

Preparation of Charge Generation Layer

Subsequently, 1 part by weight of a titanylphthalocyanine showing a main peak at a Bragg angle (2θ±0.2°) of 27.3° in an X-ray diffraction spectrum as observed with the CuKα characteristic X-ray having a wavelength of 1.541 Å as a charge generation material and 1 part by weight of butyral resin (trade name: S-LEC BM-2, available from Sekisui Chemical Co., Ltd.) as a binder resin were mixed with 98 parts by weight of methyl ethyl ketone, and dispersed with a paint shaker for 8 hours to give 3 liters of a coating solution for charge generation layer formation.

The resulting coating solution for charge generation layer formation was applied to a surface of the previously-formed undercoat layer in the same manner as in the undercoat layer formation and air-dried to give a charge generation layer having a film thickness of 0.3 μm.

Preparation of Charge Transport Layer

In a 1-liter polypropylene container, 200 g of Lubron L-2 as commercial polytetrafluoroethylene (PTFE) particles (primary particle diameter: 200 to 300 nm, available from Daikin Industries, Ltd.) was enclosed and irradiated with 150 kGy of gamma radiation from cobalt-60 in the atmosphere at normal temperature and normal humidify (25° C. and 50%). The oxygen composition ratio of the gamma-irradiated cross-linked PTFE fine particles was evaluated with an x-ray fluorescent machine (ZSX primus II, available from Rigaku Corporation) under conditions of 30 kV and 100 mA to find that oxygen-containing cross-linked PTFE fine particles (may be referred to as oxygen-containing fluorinated fine particles) having an oxygen composition ratio of 1.05% were obtained.

Subsequently, a suspension having a solid content of 21% by weight was prepared by mixing and suspending 100 parts by weight of a compound 1 (T2269, available from Tokyo Chemical Industry Co., Ltd.), as a charge transport material, represented by the following formula 1, 180 parts by weight of a polycarbonate resin (TS2050, available from TEIJIN CHEMICALS LTD.) and 30 parts by weight of the gamma-irradiated cross-linked PTFE fine particles in tetrahydrofuran as a solvent.

(1)

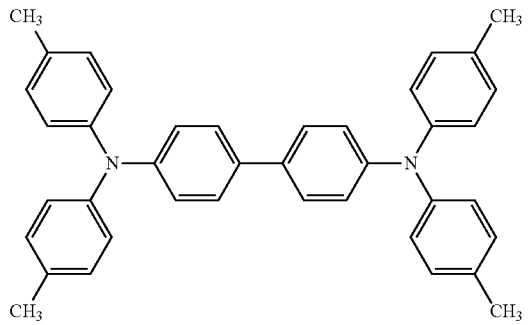

Thereafter, the suspension was passed through a wet type emulsifying and dispersing machine (Microfluidizer M-110P, available from Microfluidics) five times at a pressure set at 100 MPa to give 3 kg of a coating solution for charge transport layer formation. The coating solution for charge transport layer formation was applied onto a surface of the previously-prepared charge generation layer by dip coating and dried at 120° C. for 1 hour to give a charge transport layer having a film thickness of 28 μm. Thus, the multilayered photoreceptor shown in FIG. 1 was prepared.

Example 2A

An interlayer and a charge generation layer were prepared in the same manner as in Example 1A.

Thereafter, a multilayered photoreceptor of Example 2A was prepared in the same manner as in Example 1A except that oxygen-containing fluorinated fine particles irradiated with 400 kGy of gamma radiation in the same irradiation manner as in Example 1A were used as PTFE fine particles in the preparation of a coating solution for charge transport layer formation.

The oxygen composition ratio of the gamma-irradiated cross-linked PTFE fine particles was evaluated in the same manner as in Example 1A to find that oxygen-containing cross-linked PTFE fine particles having an oxygen composition ratio of 1.55% were obtained.

Example 3A

An interlayer and a charge generation layer were prepared in the same manner as in Example 1A.

Thereafter, a multilayered photoreceptor of Example 3A was prepared in the same manner as in Example 1A except that cross-linked PTFE fine particles irradiated with 700 kGy of gamma radiation in the same gamma irradiation manner as in Example 1A were used in the preparation of a coating solution for charge transport layer formation.

The oxygen composition ratio of the gamma-irradiated cross-linked PTFE fine particles was evaluated in the same manner as in Example 1A to find that oxygen-containing cross-linked PTFE fine particles having an oxygen composition ratio of 2.28% were obtained.

Example 4A

An interlayer and a charge generation layer were prepared in the same manner as in Example 1A.

Preparation of Charge Transport Layer

Into a 30-ml glass ampule, 5 ml of acetone and 0.2 ml of tetrafluoroethylene monomer (TFE) (measured as the volume of a liquid obtained by once solidifying the monomer with liquid nitrogen, and then melting the same in the glass ampule) were poured to give a mixed solution having a TFE concentration of 4% by volume. The glass ampule was placed in a mixture of dry ice and methanol to cool the solution to −78° C., and the solution was irradiated with 60 kGy of gamma radiation from cobalt-60 in vacuo, and then the temperature thereof was returned to room temperature to give a dispersion of polytetrafluoroethylene (PTFE) fine particles. The resulting dispersion was cooled to −78° C. again and irradiated with gamma radiation again in the same manner as described above to concentrate acetone, thereby giving a dispersion of cross-linked PTFE fine particles. This process was repeated to give a dispersion (0.5 kg) containing 20% by weight of cross-linked PTFE fine particles.

The resulting particles had a diameter of 0.3 μm. The solvent of the resulting dispersion of cross-linked PTFE fine particles was evaporated, and the oxygen composition ratio of the fine particles was evaluated in the same manner as in Examples 1A to 3A to find that oxygen-containing cross-linked PTFE fine particles having an oxygen composition ratio of 1.73% were obtained.

Subsequently, 100 parts by weight of compound 1 (T2269, available from Tokyo Chemical Industry Co., Ltd.) as a charge transport material used in Example 1A, 180 parts by weight of a polycarbonate resin (TS2050, available from TEIJIN CHEMICALS LTD.) and 156 parts by weight of the dispersion of cross-linked PTFE fine particles obtained as described above were mixed and suspended in tetrahydrofuran as a solvent to give a suspension (1.5 kg) having a solid content of 21% by weight. Thereafter, a multilayered photoreceptor was obtained in the same manner as in Example 1A.

Example 5A

An interlayer and a charge generation layer were prepared in the same manner as in Example 1A.

Preparation of Charge Transport Layer

A photoreceptor was obtained in the same manner as in Example 4A except that 10 ml of acetone and 0.1 ml of TFE were added in the preparation of a dispersion of cross-linked PTFE fine particles. The resulting cross-linked PTFE fine particles had a particle diameter of 0.15 μm. In addition, the oxygen composition ratio of the fine particles was evaluated in the same manner as in Example 4A to find that oxygen-containing cross-linked PTFE fine particles having an oxygen composition ratio of 1.7% were obtained.

Example 6A

A multilayered photoreceptor was obtained in the same manner as in Example 1A except that KTL-1N (primary particle diameter: 2 μm, available from KITAMURA LIMITED) was used as PTFE fine particles in the charge transport layer.

The oxygen composition ratio of the gamma-irradiated cross-linked PTFE fine particles used in the present example was evaluated in the same manner as in Example 4A to find that oxygen-containing cross-linked PTFE fine particles having an oxygen composition ratio of 1.1% were obtained.

Example 7A

A photoreceptor was obtained in the same manner as in Example 6A except that the PTFE fine particles used in Example 6A were preliminarily milled (primary particle diameter: 0.8 μm) with a high-speed dry milling machine (Nano Jetmizer, available from Aishin Nano Technologies CO., LTD.)

The oxygen composition ratio of the gamma-irradiated cross-linked PTFE fine particles used in the present example was evaluated in the same manner as in Example 4A to find that oxygen-containing cross-linked PTFE fine particles having an oxygen composition ratio of 1.4% were obtained.

Example 8A

An interlayer and a charge generation layer were prepared, and then a suspension of cross-linked PTFE fine particles was prepared in the same manner as in Example 4A.

Subsequently, 100 parts by weight of compound 1 (T2269, available from Tokyo Chemical Industry Co., Ltd.) as a charge transport material used in Example 4A, 180 parts by weight of a polycarbonate resin (TS2050, available from TEIJIN CHEMICALS LTD.) and 21.5 parts by weight of the dispersion of cross-linked PTFE fine particles obtained as described above were mixed and suspended in tetrahydrofuran as a solvent to give a suspension (1.5 kg) having a solid content of 21% by weight. Thereafter, a multilayered photoreceptor was obtained in the same manner as in Example 4A.

Example 9A

An interlayer and a charge generation layer were prepared, and then a suspension of cross-linked PTFE fine particles was prepared in the same manner as in Example 4A.

Subsequently, 100 parts by weight of compound 1 (T2269, available from Tokyo Chemical Industry Co., Ltd.) as a charge transport material used in Example 4A, 180 parts by weight of a polycarbonate resin (TS2050, available from TEIJIN CHEMICALS LTD.) and 106 parts by weight of the dispersion of cross-linked PTFE fine particles obtained as described above were mixed and suspended in tetrahydrofuran as a solvent to give a suspension (1.5 kg) having a solid content of 21% by weight. Thereafter, a multilayered photoreceptor was obtained in the same manner as in Example 4A.

Example 10A

An interlayer and a charge generation layer were prepared, and then a suspension of cross-linked PTFE fine particles was prepared in the same manner as in Example 4A.

Subsequently, 100 parts by weight of compound 1 (T2269, available from Tokyo Chemical Industry Co., Ltd.) as a charge transport material used in Example 4A, 180 parts by weight of a polycarbonate resin (TS2050, available from TEIJIN CHEMICALS LTD.) and 230 parts by weight of the dispersion of cross-linked PTFE fine particles obtained as described above were mixed and suspended in tetrahydrofuran as a solvent to give a suspension (1.5 kg) having a solid content of 21% by weight. Thereafter, a multilayered photoreceptor was obtained in the same manner as in Example 4A.

Example 11A

An interlayer and a charge generation layer were prepared in the same manner as in Example 2A.

Here, oxygen-containing fluorinated fine particles irradiated with 400 kGy of gamma radiation in the same irradiation manner as in Example 2A were used as PTFE fine particles in the preparation of a coating solution for charge transport layer formation. Subsequently, 100 parts by weight of compound 1 (T2269, available from Tokyo Chemical Industry Co., Ltd.) as a charge transport material, 180 parts by weight of a polycarbonate resin (TS2050, available from TEIJIN CHEMICALS LTD.) and 61.5 parts by weight of the gamma-irradiated PTFE fine particles were mixed, and a multilayered photoreceptor was obtained in the same manner as in Example 2A.

Example 12A

An interlayer and a charge generation layer were prepared in the same manner as in Example 2A.

Here, oxygen-containing fluorinated fine particles irradiated with 400 kGy of gamma radiation in the same irradiation manner as in Example 2A were used as PTFE fine particles in the preparation of a coating solution for charge transport layer formation. Subsequently, 100 parts by weight of compound 1 (T2269, available from Tokyo Chemical Industry Co., Ltd.) as a charge transport material, 180 parts by weight of a polycarbonate resin (TS2050, available from TEIJIN CHEMICALS LTD.) and 104 parts by weight of the gamma-irradiated PTFE fine particles were mixed, and a multilayered photoreceptor was obtained in the same manner as in Example 2A.

Example 13A

A first charge transport layer having a thickness of 15 μm was prepared in the same manner as in Example 1A except that no PTFE fine particles were added to the charge transport layer. Thereafter, a coating solution having the same component ratio as in Comparative Example 7A to be described later was applied to form a second charge transport layer having a thickness of 10 μm and dried at 120° C. to give a photoreceptor.

Comparative Example 1A

A photoreceptor was prepared in the same manner as in Example 1A except that no PTFE fine particles were added to the charge transport layer.

Comparative Example 2A

A photoreceptor was prepared using the same PTFE fine particles as those of Example 1A in the same manner as in Example 1A except that the gamma irradiation was not performed. The oxygen composition ratio of the particles used in the present example was evaluated to be 0.55%. However, the value 0.55% was at the background level because of white X-rays in the measurement with X-ray fluorescence, and therefore it was determined that the particles actually contained no oxygen.

Comparative Example 3A

A photoreceptor was prepared using the same PTFE fine particles as those of Example 1 (the gamma irradiation was not performed) in the same manner as in Example 1A except that 1 part by weight of GF-400 (available from TOAGOSEI CO., LTD.) was added as a dispersant for the fine particles.

Comparative Example 4A

A photoreceptor was prepared in the same manner as in Example 1A except that the same PTFE fine particles as those of Example 1A were irradiated with 1000 kGy of gamma radiation.

The oxygen composition ratio of the gamma-irradiated cross-linked PTFE fine particles used in the present example was evaluated in the same manner as in Example 4A to find that oxygen-containing cross-linked PTFE fine particles having an oxygen composition ratio of 3.31% were obtained.

Comparative Example 5A

A photoreceptor was prepared in the same manner as in Comparative Example 3A except that tetrafluoroethylene-perfluoroalkyl (PFA) MP101 (available from Du Pont-Mitsui Fluorochemicals Co., Ltd.) was used as fluorinated fine particles.

The oxygen composition ratio of the PFA particles used in the present example was evaluated to be 0.70%. However, the value 0.70% was at the background level because of white X-rays in the measurement with X-ray fluorescence, and therefore it was determined that the particles actually contained no oxygen.

Comparative Example 6A

An interlayer and a charge generation layer were prepared, and then a suspension of cross-linked PTFE fine particles was prepared in the same manner as in Example 4A.

Subsequently, 100 parts by weight of compound 1 (T2269, available from Tokyo Chemical Industry Co., Ltd.) as a charge transport material used in Example 4A, 180 parts by weight of a polycarbonate resin (TS2050, available from TEIJIN CHEMICALS LTD.) and 8 parts by weight of the dispersion of cross-linked PTFE fine particles obtained as described above were mixed and suspended in tetrahydrofuran as a solvent to give a suspension having a solid content of 21% by weight. Thereafter, a multilayered photoreceptor was obtained in the same manner as in Example 4A.

Comparative Example 7A

An interlayer and a charge generation layer were prepared in the same manner as in Example 2A.

Here, oxygen-containing fluorinated fine particles irradiated with 400 kGy of gamma radiation in the same irradiation manner as in Example 2A were used as PTFE fine particles in the preparation of a coating solution for charge transport layer formation. Subsequently, 100 parts by weight of compound 1 (T2269, available from Tokyo Chemical Industry Co., Ltd.) as a charge transport material, 180 parts by weight of a polycarbonate resin (TS2050, available from TEIJIN CHEMICALS LTD.) and 151 parts by weight of the gamma-irradiated PTFE fine particles were mixed, and a multilayered photoreceptor was obtained in the same manner as in Example 2A.

Evaluations

1. Evaluation of Primary Particle Diameter of Filler Particles

Each filler was measured for the primary particle diameter with a scanning electron microscope (S4800, available from Hitachi, Ltd.)

2. Evaluation of Particle Size in Coating Solution for Charge Transport Layer Formation The coating solution for charge transport layer formation used in each of Examples 1A to 13A and Comparative Examples 2A to 7A was evaluated for the stability of the filler dispersion state with a laser diffraction particle sizer (Microtrack MT-3000II, available from Nikkiso Co., Ltd.)

In the evaluation, 40 cc of each coating solution was taken and moved to a sample tube (50 cc) immediately after completion of the dispersion, agitated with a stirrer (100 rpm, 15 h), and then measured and compared for the particle size distribution (D50).

VG (very good): very good (D50<1.0 μm)

G (good): good (1.0 μm≤D50<3.0 μm)

NB (not bad): tolerable for practical use (3.0 μm≤D50<6.0 μm)

B (bad): not tolerable for practical use (6.0 μm≤D50)

The photoreceptor obtained in each example or comparative example was mounted in a test copying machine obtained by modifying a digital copying machine (trade name: MX-2600, available from Sharp Corporation), provided with a surface potentiometer (model 344, available from TREK JAPAN) for measuring the surface potential of the photoreceptor in the image formation step, and evaluated for the electric properties and the image quality. A laser beam having a wavelength of 780 nm was used as a light source.

3. Evaluation of Electric Properties

First, with the above-described copying machine, each photoreceptor was measured for the surface potential VL in its black region upon the exposure to see the surface potential of the photoreceptor in the developing section, that is, the sensibility of the photoreceptor. The surface potential VL in an initial stage and immediately after repeated copying of 100K sheets was determined under a normal temperature/normal humidify (abbreviated as "N/N") environment at 25° C./50% RH (relative humidity)), and their difference ΔVL was evaluated according to the following criteria.

ΔVL

VG: ΔVL≤10

G: 10<ΔVL<20

NB: 20≤ΔVL≤50

B: 50<ΔVL

4. Evaluation of Image

Each photoreceptor was mounted in the copying machine, and then a full white image was printed on 10 sheets. The number of visible black dots (diameter 0.4 mm) whose generation cycle agrees with the cycle of the photoreceptor per sheet of hard copy (A3) was counted. The results were evaluated according to the following criteria.

VG: good; 3 or less black dots were generated per sheet for all the hard copies.

G: no problem for practical use; 4-7 black dots were generated per sheet for all the hard copies.

NB: tolerable for practical use; 8-10 black dots were generated per sheet for all the hard copies.

B: not tolerable for practical use; 11 or more black dots were generated per sheet for one or more hard copies.

5. Evaluation of Film Loss

A change in the film thickness of each photoreceptor between before and after the actual copying of 100 k sheets was measured with an eddy-current thickness meter (available from Fischer Instruments K.K.), and converted to a film loss amount (A) per 100 k revolutions of the photoreceptor in the copying machine and evaluated relative to the case of a filler-free photoreceptor.

VG: very well improved (Δ<0.5 μm/100 k revolutions)

G: well improved (0.5 μm/100 k revolutions≤Δ<1.0 μm/100 k revolutions)

NB: improved (1.0 μm/100 k revolutions≤Δ<2.0 μm/100 k revolutions)

B: not improved (2.0 μm/100 k revolutions≤Δ)

Note that the photoreceptor of Comparative Example 2A was not evaluable for the film loss amount (Δ) after the actual copying of 100 k sheets since the image quality was significantly poor in the initial stage due to aggregation of the fluorinated fine particles in the film.

Table 1 shows the results of the above-described evaluation as well as the primary particle diameter (μm) of the filler particles, the oxygen composition ratio of the filler particles and the amount of the filler particles added.

Overall Evaluation

The results of the evaluation items 1 to 5 were collectively evaluated according to the following evaluation criteria.

VG: very good, no problem at all for practical use; all the items were evaluated to be G at worst.

G: good, no problem for practical use; one or two items were evaluated to be NB at worst.

NB: tolerable for practical use; three or more items were evaluated to be NB but no item was evaluated to be B.

B: not tolerable for practical; one or more items were evaluated to be B.

TABLE 1

| | Primary particle diameter of filler particles [μm] | Oxygen composition ratio (X-ray fluorescence analysis) | Amount of filler (wt %) | Dispersion stability of coating solution Particle size: d50 (μm) | Dispersion stability of coating solution Evaluation | Electric properties Initial stage VL (-V) | Electric properties After actual copying of 100K sheets VL (-V) | Electric properties ΔVL | Electric properties Evaluation |
|---|---|---|---|---|---|---|---|---|---|
| Example 1A | 0.3 | 1.05 | 10.0% | 3.0 | G | 95 | 112 | 17 | G |
| Example 2A | 0.3 | 1.55 | 10.0% | 2.0 | G | 90 | 105 | 15 | G |
| Example 3A | 0.3 | 2.28 | 10.0% | 1.8 | VG | 65 | 85 | 20 | NB |
| Example 4A | 0.3 | 1.73 | 10.0% | 1.5 | VG | 62 | 72 | 10 | VG |
| Example 5A | 0.15 | 1.7 | 10.0% | 1.2 | VG | 65 | 74 | 9 | VG |
| Example 6A | 2 | 1.1 | 10.0% | 5.0 | NB | 100 | 118 | 18 | G |
| Example 7A | 0.8 | 1.4 | 10.0% | 2.9 | G | 93 | 110 | 17 | G |
| Comparative Example 1A | — | — | — | — | | 100 | 108 | 8 | VG |
| Comparative Example 2A | 0.3 | 0.55 | 10.0% | >30.0 | B | 120 | 200 | 80 | B |
| Comparative Example 3A | 0.3 | 0.55 | 10.0% | 20.0 | B | 103 | 126 | 23 | NB |
| Comparative Example 4A | 0.3 | 3.31 | 10.0% | 1.3 | VG | 50 | 120 | 70 | B |
| Comparative Example 5A | 2 | 0.7 | 10.0% | 20.0 | B | 120 | 140 | 20 | NB |
| Example 8A | 0.3 | 1.73 | 1.5% | 1.3 | VG | 102 | 111 | 9 | VG |
| Example 9A | 0.3 | 1.73 | 7.0% | 1.4 | VG | 78 | 85 | 7 | VG |
| Example 10A | 0.3 | 1.73 | 14.0% | 1.7 | VG | 58 | 70 | 12 | G |
| Example 11A | 0.3 | 1.55 | 18.0% | 2.0 | G | 102 | 145 | 43 | NB |
| Example 12A | 0.3 | 1.55 | 27.0% | 2.5 | G | 125 | 165 | 40 | NB |
| Example 13A | 0.3 | 1.55 | 35.0% | 5.0 | NB | 115 | 127 | 12 | G |
| Comparative Example 6A | 0.3 | 1.73 | 0.5% | 1.0 | VG | 98 | 106 | 8 | NB |
| Comparative Example 7A | 0.3 | 1.55 | 35.0% | 5.0 | NB | 155 | 260 | 105 | B |

| | Image quality Image defect | Film loss amount (μm/100k revolutions) | Evaluation of film loss | Overall evaluation |
|---|---|---|---|---|
| Example 1A | G | 0.60 | G | G |
| Example 2A | G | 0.61 | G | G |
| Example 3A | G | 0.70 | G | G |
| Example 4A | VG | 0.67 | G | VG |
| Example 5A | VG | 1.20 | NB | G |
| Example 6A | NB | 0.55 | G | NB |
| Example 7A | G | 0.53 | G | G |
| Comparative Example 1A | G | 2.55 | B | B |
| Comparative Example 2A | B | N.D. | B | B |
| Comparative Example 3A | G | 0.61 | G | B |
| Comparative Example 4A | B | 1.01 | NB | B |
| Comparative Example 5A | NB | 0.51 | G | B |
| Example 8A | G | 1.40 | NB | NB |
| Example 9A | G | 0.98 | G | G |
| Example 10A | G | 0.60 | G | G |
| Example 11A | NB | 0.52 | G | NB |
| Example 12A | NB | 0.33 | G | NB |
| Example 13A | G | 0.28 | G | G |
| Comparative Example 6A | G | 2.20 | B | B |
| Comparative Example 7A | B | 0.29 | G | B |

Table 1 has revealed that the electrophotographic photoreceptors of Examples 1A to 13A, in which the surface layer contains oxygen-containing fluorinated fine particles, the oxygen-containing fluorinated fine particles have an oxygen composition ratio of 0.9 to 3.0% by atom based on the whole composition of the fine particles according to an X-ray fluorescence composition analysis, the oxygen-containing fluorinated fine particles include primary particles having a median size (D50) of 0.1 to 2 μm, and the content of the oxygen-containing fluorinated fine particles is 1.0 to 40%, are superior to the photoreceptors of Comparative Examples 1A to 7A in all the evaluation items.

Example 1B

Preparation of Interlayer

To 25 parts by weight of methyl alcohol, 3 parts by weight of titanium oxide (trade name: TIPAQUE TTO-D-1, available from Ishihara Sangyo Kaisha, Ltd.) and 2 parts by weight of a commercial polyamide resin (trade name: Amilan CM8000, available from Toray Industries, Inc.) were added and dispersed with a paint shaker for 8 hours to give 3 kg of a coating solution for interlayer formation. A drum-like aluminum support having a diameter of 30 mm and a length of 357 mm as a conductive support was dipped in a coating vessel filled with the coating solution for interlayer formation obtained, and then raised to form an interlayer having a film thickness of 1 μm.

Preparation of Charge Generation Layer

Subsequently, 1 part by weight of a titanylphthalocyanine showing a main peak at a Bragg angle (2θ±0.2°) of 27.3° in an X-ray diffraction spectrum as observed with the CuKα characteristic X-ray having a wavelength of 1.541 Å as a charge generation material and 1 part by weight of butyral resin (trade name: S-LEC BM-2, available from Sekisui Chemical Co., Ltd.) as a binder resin were mixed with 98 parts by weight of methyl ethyl ketone, and dispersed with a paint shaker for 8 hours to give 3 liters of a coating solution for charge generation layer formation.

The resulting coating solution for charge generation layer formation was applied to a surface of the previously-formed undercoat layer in the same manner as in the undercoat layer formation and air-dried to give a charge generation layer having a film thickness of 0.3 μm.

Preparation of Charge Transport Layer

In a 1-liter polypropylene container, 200 g of Lubron L-2 (primary particle diameter: 200 to 300 nm, available from Daikin Industries, Ltd.) as commercial polytetrafluoroethylene (PTFE) particles was enclosed and irradiated with 150 kGy of gamma radiation from cobalt-60 in the atmosphere at normal temperature and normal humidify (25° C. and 50%). The oxygen composition ratio of the gamma-irradiated cross-linked PTFE fine particles was evaluated with an x-ray fluorescent machine (ZSX primus II, available from Rigaku Corporation) under conditions of 30 kV and 100 mA to find that oxygen-containing cross-linked PTFE fine particles (may be referred to as oxygen-containing fluorinated fine particles) having an oxygen composition ratio of 1.05% were obtained.

Subsequently, a suspension (1.5 kg) having a solid content of 21% by weight was prepared by mixing and suspending 100 parts by weight of a compound 1' (D3236, available from Tokyo Chemical Industry Co., Ltd.), as a charge transport material, represented by the following formula (1)' and having an ionization potential of 5.53 eV, 180 parts by weight of a polycarbonate resin (TS2050, available from TEIJIN CHEMICALS LTD.) and 30 parts by weight of the gamma-irradiated PTFE fine particles (particulate solid content: 10% by weight) in tetrahydrofuran as a solvent.

(1')

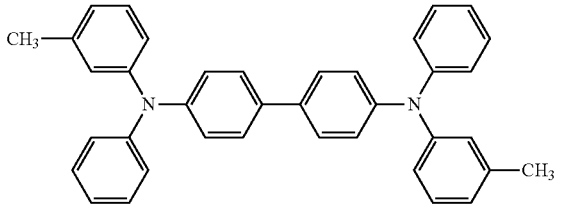

I P = 5.53

Thereafter, the suspension was passed through a wet type emulsifying and dispersing machine (Microfluidizer M-110P, available from Microfluidics) five times at a pressure set at 100 MPa to give 3 kg of a coating solution for charge transport layer formation. The coating solution for charge transport layer formation was applied onto a surface of the previously-prepared charge generation layer by dip coating and dried at 120° C. for 1 hour to give a charge transport layer having a film thickness of 28 μm as an outermost layer. Thus, the multilayered photoreceptor shown in FIG. 1 was prepared.

Example 2B

An interlayer and a charge generation layer were prepared in the same manner as in Example 1B.

Thereafter, a multilayered photoreceptor of Example 2B was prepared in the same manner as in Example 1B except that oxygen-containing fluorinated fine particles irradiated with 400 kGy of gamma radiation in the same irradiation manner as in Example 1B were used as PTFE fine particles in the preparation of a coating solution for charge transport layer formation. The oxygen composition ratio of the oxygen-containing fluorinated fine particles used in the present example was evaluated in the same manner as in Example 1B to find that oxygen-containing fluorinated fine particles having an oxygen composition ratio of 1.55% were obtained.

Example 3B

An interlayer and a charge generation layer were prepared in the same manner as in Example 1B.

Thereafter, a multilayered photoreceptor of Example 3B was prepared in the same manner as in Example 1B except that oxygen-containing fluorinated fine particles irradiated with 700 kGy of gamma radiation in the same irradiation manner as in Example 1B were used as oxygen-containing fluorinated fine particles in the preparation of a coating solution for charge transport layer formation. The oxygen composition ratio of the oxygen-containing fine particles used in the present example was evaluated in the same manner as in Example 1B to find that oxygen-containing fluorinated fine particles having an oxygen composition ratio of 2.28% were obtained.

Example 4B

An interlayer and a charge generation layer were prepared in the same manner as in Example 1B.

Preparation of Charge Transport Layer

Into a 30-ml glass ampule, 5 ml of acetone and 0.2 ml of tetrafluoroethylene monomer (TFE) (measured as the volume of a liquid obtained by once solidifying the monomer with liquid nitrogen, and then melting the same in the glass ampule) were poured to give a mixed solution having a TFE concentration of 4% by volume. The glass ampule was placed in a mixture of dry ice and methanol to cool the solution to −78° C., and the solution was irradiated with 60 kGy of gamma radiation from cobalt-60 in vacuo, and then the temperature thereof was returned to room temperature to give a dispersion of polytetrafluoroethylene (PTFE) fine particles. The resulting dispersion was cooled to −78° C. again and irradiated with gamma radiation again in the same manner as described above to concentrate acetone, thereby giving a dispersion of cross-linked PTFE fine particles. This process was repeated to give a dispersion (1.5 kg) containing 20% by weight of cross-linked PTFE fine particles.

The resulting particles had a diameter of 0.3 μm. The solvent of the resulting dispersion of cross-linked PTFE fine particles was evaporated, and the oxygen composition ratio of the fine particles was evaluated in the same manner as in Examples 1B to 3B to find that oxygen-containing fluorinated fine particles having an oxygen composition ratio of 1.73% were obtained.

Subsequently, 100 parts by weight of a compound 2' (available from Takasago International Corporation), as a charge transport material, represented by the following formula 2' and having an ionization potential of 5.29 eV, 180 parts by weight of a polycarbonate resin (TS2050, available from TEIJIN CHEMICALS LTD.) and 156 parts by weight of the dispersion of cross-linked PTFE fine particles obtained as described above were mixed and suspended in tetrahydrofuran as a solvent to give a suspension (1.5 kg) having a solid content of 21% by weight.

(2')

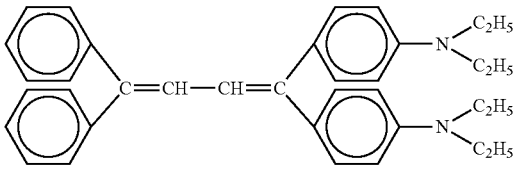

I P = 5.29

Thereafter, a multilayered photoreceptor was obtained in the same manner as in Example 1B.

Example 5B

An interlayer and a charge generation layer were prepared in the same manner as in Example 1B.

Thereafter, a multilayered photoreceptor of Example 5B was prepared in the same manner as in Example 4B except that compound 3' (T2269, available from Tokyo Chemical Industry Co., Ltd.) represented by the following formula 3' and having an ionization potential of 5.32 eV was used as a charge transport material in the preparation of a coating solution for charge transport layer formation.

(3')

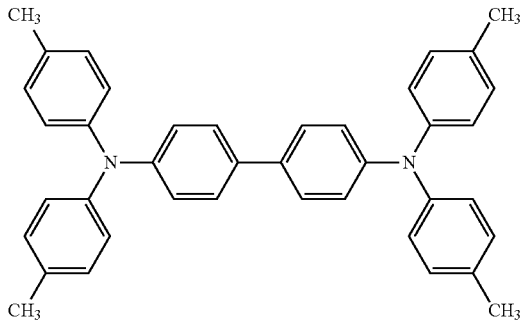

I P = 5.32

Example 6B

An interlayer and a charge generation layer were prepared in the same manner as in Example 1B.

Thereafter, a multilayered photoreceptor of Example 6B was prepared in the same manner as in Example 4B except that compound 1' was used as a charge transport material in the preparation of a coating solution for charge transport layer formation.

Example 7B

An interlayer and a charge generation layer were prepared in the same manner as in Example 1B.

Thereafter, a multilayered photoreceptor of Example 7B was prepared in the same manner as in Example 4B except that compound 4' represented by the following formula 4' and having an ionization potential of 5.60 eV was used as a charge transport material in the preparation of a coating solution for charge transport layer formation.

(4')

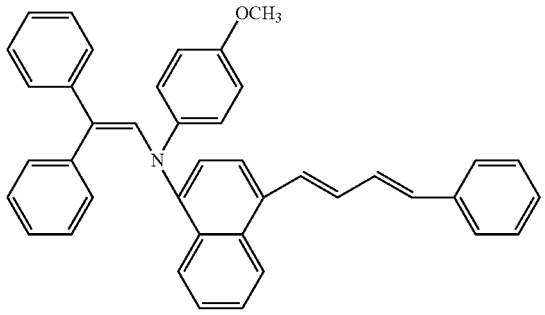

I P = 5.60

Example 8B

An interlayer and a charge generation layer were prepared in the same manner as in Example 1B.

Thereafter, a multilayered photoreceptor of Example 8B was prepared in the same manner as in Example 4B except that compound 5' represented by the following formula 5' and having an ionization potential of 5.63 eV was used as a charge transport material in the preparation of a coating solution for charge transport layer formation.

(5')

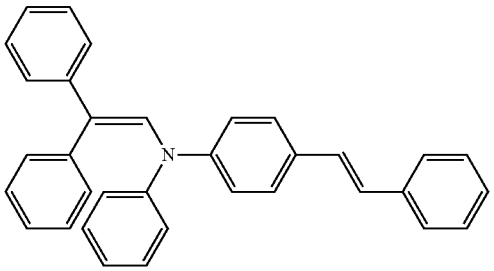

I P = 5.63

Example 9B

A multilayered photoreceptor of Example 9B was prepared in the same manner as in Example 4B except that compound 6' represented by the following formula 6' and having an ionization potential of 5.65 eV was used as a charge transport material in the preparation of a coating solution for charge transport layer formation.

(6')

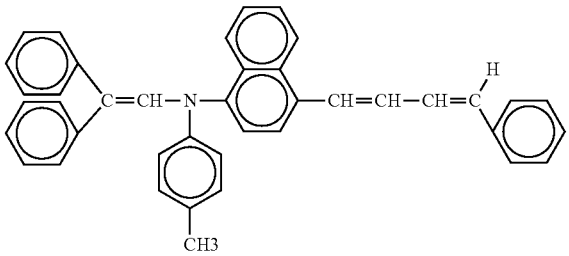

I P = 5.65

Example 10B

An interlayer and a charge generation layer were prepared, and then a suspension of cross-linked PTFE fine particles was prepared in the same manner as in Example 4B.

Subsequently, 100 parts by weight of compound 1' (D3236, available from Tokyo Chemical Industry Co., Ltd.) as a charge transport material used in Example 6B, 180 parts by weight of a polycarbonate resin (TS2050, available from TEIJIN CHEMICALS LTD.) and 106 parts by weight of the dispersion of cross-linked PTFE fine particles obtained as described above (particulate solid content: 7% by weight) were mixed and suspended in tetrahydrofuran as a solvent to give a suspension having a solid content of 21% by weight. Thereafter, a multilayered photoreceptor of Example 10B was obtained in the same manner as in Example 5B.

Example 11B

An interlayer and a charge generation layer were prepared in the same manner as in Example 1B.

Here, oxygen-containing fluorinated fine particles irradiated with 400 kGy of gamma radiation in the same irradiation manner as in Example 2B were used in the preparation of a coating solution for charge transport layer formation. Subsequently, 100 parts by weight of compound 1' (D3236, available from Tokyo Chemical Industry Co., Ltd.) as a charge transport material, 180 parts by weight of a polycarbonate resin (TS2050, available from TEIJIN CHEMICALS LTD.) and 61.5 parts by weight of the gamma-irradiated PTFE fine particles (referred as oxygen-containing fluorinated fine particles) (particulate solid content: 18% by weight) were mixed, and a multilayered photoreceptor of Example 11B was obtained in the same manner as in Example 1B.

Example 12B

A first charge transport layer having a thickness of 15 μm was prepared in the same manner as in Example 1B except that no PTFE fine particles were added to the charge transport layer.

Here, for a second charge transport layer, oxygen-containing fluorinated fine particles irradiated with 400 kGy of gamma radiation in the same irradiation manner as in Example 2B were used as PTFE fine particles in the preparation of a coating solution for charge transport layer formation. Subsequently, 100 parts by weight of the charge transport material (D3236, available from Tokyo Chemical Industry Co., Ltd.), 180 parts by weight of a polycarbonate resin (TS2050, available from TEIJIN CHEMICALS LTD.) and 151 parts by weight of the gamma-irradiated PTFE fine particles (referred as oxygen-containing fluorinated fine particles) (particulate solid content: 35% by weight) were mixed, applied in the same manner as in Example 2B, and then dried at 120 C to give a photoreceptor of Example 12B including the second charge transport layer having a thickness of 10 μm.

Example 13B

A multilayered photoreceptor of Example 13B was prepared in the same manner as in Example 11B except that compound 3' (T2269, available from Tokyo Chemical Industry Co., Ltd.) was used as a charge transport material in the preparation of a coating solution for charge transport layer formation.

Comparative Example 1B

A photoreceptor was prepared in the same manner as in Example 1B except that no oxygen-containing fluorinated fine particles were added to the charge transport layer, and compound 2' was used as a charge transport material.

Comparative Example 2B

A photoreceptor was prepared in the same manner as in Example 1B except that no oxygen-containing fluorinated fine particles were added to the charge transport layer, and compound 3' was used as a charge transport material.

Comparative Example 3B

A photoreceptor was prepared using the same PTFE fine particles as those of Example 1B in the same manner as in Example 1B except that the gamma irradiation was not performed.

The oxygen composition ratio of the particles used in the present example was evaluated to be 0.55%. However, the value 0.55% was at the background level because of white X-rays in the measurement with X-ray fluorescence, and therefore it was determined that the particles actually contained no oxygen.

Comparative Example 4B

A photoreceptor was prepared using the same PTFE fine particles as those of Example 1B (the gamma irradiation was not performed) in the same manner as in Example 1B except that 1 part by weight of GF-400 (available from TOAGOSEI CO., LTD.) was added as a dispersant for the fine particles.

Comparative Example 5B

A photoreceptor was prepared in the same manner as in Example 1B except that the same PTFE fine particles as those of Example 1B were irradiated with 1000 kGy of gamma radiation.

The oxygen composition ratio of the gamma-irradiated PTFE fine particles used in the present example was evaluated in the same manner as in Example 1B to find that oxygen-containing fluorinated fine particles having an oxygen composition ratio of 3.31% were obtained.

Comparative Example 6B

A photoreceptor was prepared in the same manner as in Comparative Example 1B except that tetrafluoroethylene-perfluoroalkyl (PFA) MP101 (available from Du Pont-Mitsui Fluorochemicals Co., Ltd.) was used as fluorinated fine particles.

The oxygen composition ratio of the PFA particles used in the present example was evaluated in the same manner as in Example 1B to be 0.70%. However, the value 0.70% was at the background level because of white X-rays in the measurement with X-ray fluorescence, and therefore it was determined that the particles actually contained no oxygen.

Comparative Example 7B

A photoreceptor was prepared in the same manner as in Example 4B except that compound 7' represented by the following formula 7' and having an ionization potential of 5.20 eV was used as a charge transport material.

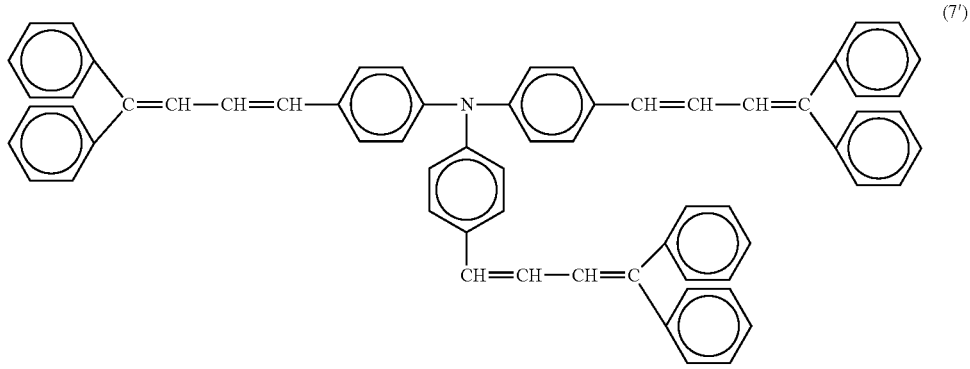

Comparative Example 8B

An interlayer and a charge generation layer were prepared, and then a suspension of cross-linked PTFE fine particles was prepared in the same manner as in Example 4B.

Subsequently, 100 parts by weight of compound 1' (D3236, available from Tokyo Chemical Industry Co., Ltd.) as a charge transport material used in Example 5B, 180 parts by weight of a polycarbonate resin (TS2050, available from TEIJIN CHEMICALS LTD.) and 8 parts by weight of the dispersion of cross-linked PTFE fine particles obtained as described above (particulate solid content: 1% by weight) were mixed and suspended in tetrahydrofuran as a solvent to give a suspension having a solid content of 21% by weight. Thereafter, a multilayered photoreceptor of Comparative Example 8B was obtained in the same manner as in Example 5B.

Comparative Example 9B

An interlayer and a charge generation layer were prepared in the same manner as in Example 1B.

Here, oxygen-containing fluorinated fine particles irradiated with 400 kGy of gamma radiation in the same irradiation manner as in Example 2B were used as PTFE fine particles in the preparation of a coating solution for charge transport layer formation. Subsequently, 100 parts by weight of the charge transport material (D3236, available from Tokyo Chemical Industry Co., Ltd.), 180 parts by weight of a polycarbonate resin (TS2050, available from TEIJIN CHEMICALS LTD.) and 151 parts by weight of the gamma-irradiated PTFE fine particles (referred as oxygen-containing fluorinated fine particles) (particulate solid content: 35% by weight) were mixed, and a multilayered photoreceptor of Comparative Example 9B was obtained in the same manner as in Example 2B.

Evaluations

1. Evaluation of Dispersion Stability of Coating Solution

The coating solution for charge transport layer formation used in each of Examples 1B to 13B and Comparative Examples 3B to 9B was evaluated for the stability of the filler dispersion state with a laser diffraction particle sizer (Microtrack MT-3000II, available from Nikkiso Co., Ltd.)

In the evaluation, 40 ml of each coating solution was taken and moved to a sample tube (50 ml) immediately after completion of the dispersion, agitated with a stirrer (100 rpm, 15 h), and then measured and compared for the particle size distribution (D50).

VG (very good): very good (D50<2.0 μm)

G (good): no problem for practical use (2.0 μm≤D50<5.0 μm)

NB (not bad): tolerable for practical use (5.0 μm≤D50<8.0 μm)

B (bad): not tolerable for practical use (8.0 μm≤D50)

The photoreceptor obtained in each example or comparative example was mounted in a test copying machine obtained by modifying a digital copying machine (trade name: MX-4100, available from Sharp Corporation), provided with a surface potentiometer (model 344, available from TREK JAPAN) for measuring the surface potential of the photoreceptor in the image formation step, and evaluated for the electric properties and the image quality. A laser beam having a wavelength of 780 nm was used as a light source.

2-(1) Evaluation of Electric Properties

First, with the above-described copying machine, the photoreceptor was measured for the surface potential VL in its black region upon the exposure to see the surface potential of the photoreceptor in the developing section, that is, the sensibility of the photoreceptor. The surface potential VL in an initial stage and immediately after repeated copying of 100K sheets was determined under a normal temperature/normal humidify (abbreviated as "N/N") environment at 25° C./50% RH (relative humidity). The results were evaluated according to the following criteria.

Initial VL

VG: $|VL| \leq 70$

G: $70 < |VL| \leq 100$

NB: $100 < |VL| \leq 150$

B: $150 < |VL|$

ΔVL

VG: $\Delta VL \leq 10$

G: $10 < \Delta VL \leq 20$

NB: $20 < \Delta VL \leq 30$

B: $30 < \Delta VL$

Evaluation of Electric Properties

The worst evaluation result out of the "initial VL" and the "ΔVL" was used as the result of the evaluation of each photoreceptor for the electric properties.

2-(2) Evaluation of Image Defect

Each photoreceptor was mounted in the copying machine, and then a full white image was printed on 10 sheets. The number of visible black dots (diameter≥0.4 mm) whose generation cycle agrees with the cycle of the photoreceptor per sheet of hard copy (A3) was counted. The results were evaluated according to the following criteria.

VG: good; 3 or less black dots were generated per sheet for all the hard copies.

G: no problem for practical use; 4-7 black dots were generated per sheet for all the hard copies.

NB: tolerable for practical use; 8-10 black dots were generated per sheet for all the hard copies.

B: not tolerable for practical use; 11 or more black dots were generated per sheet for one or more hard copies.

2-(3) Evaluation of Film Loss

A change in the film thickness of each photoreceptor between before and after the actual copying of 100 k sheets was measured with an eddy-current thickness meter (available from Fischer Instruments K.K.), and converted to a film loss amount (Δ) per 100 k revolutions of the photoreceptor in the copying machine and evaluated relative to the case of a filler-free photoreceptor.

VG: very well improved ($\Delta < 0.5$ μm/100 k revolutions)

G: well improved (0.5 μm/100 k revolutions$\leq \Delta < 1.0$ μm/100 k revolutions)

NB: improved (1.0 μm/100 k revolutions$\leq \Delta < 2.0$ μm/100 k revolutions)

B: not improved (2.0 μm/100 k revolutions$\leq \Delta$)

Note that the photoreceptor of Comparative Example 3B was not evaluable for the film loss amount after the actual copying of 100 k sheets since the image quality was significantly poor in the initial stage due to aggregation of the fluorinated fine particles in the film.

2-(4) Evaluation of NOx Resistance

The copying machine was placed in a normal temperature/low humidity environment (25° C./5%), printing of 30000 sheets was performed, and then the copying machine was stopped and allowed to stand for one day. Thereafter, a halftone image was formed with the copying machine, and the image formed was evaluated by visual observation. The image was evaluated according to the following criteria.

VG: very good; completely even image density was observed.

G: no problem for practical use; substantially even image density was observed.

NB: tolerable for practical use; slightly uneven image density was observed.

B: not tolerable for practical use; uneven image density such as blank dots or image blurring was clearly observed.

Overall Evaluation

The results of the evaluations 2-(1) to 2-(4) were collectively evaluated according to the following criteria.

VG: very good with respect to extended life and higher image quality; all evaluation results were VG or G.

G: good with respect to extended life and higher image quality; only one evaluation result was NB and the others were VG or G.

NB: tolerable for practical use with respect to extended life and higher image quality; two or more evaluation results were NB but no B.

B: one or more evaluation results were B.

Table 2 shows the results of the respective evaluation items in the photoreceptors prepared in Examples 1B to 13B and Comparative Examples 1B to 9B.

TABLE 2

| | | | Charge transport layer | | | | | | | | 1. Dispersion stability | | 2-(1) |
|---|---|---|---|---|---|---|---|---|---|---|---|---|---|
| | Under coat layer | Charge generation layer | Charge transport material | IP | Filler preparation | Particle diameter μm | Oxygen composition ratio | Particulate solid content | Particle diameter after agitation (μm) | Dispersant | Particle size D50 | Evaluation | Electric properties Initial VL |
| Example 1B | Ex. 1B | Ex. 1B | Compound (1)' | 5.53 | Lubron L2 + 150 kGy | 0.3 | 1.1 | 10% | 3 | Absent | 3.0 | G | 96 |
| Example 2B | ↑ | ↑ | Compound (1)' | 5.53 | Lubron L2 + 400 kGy | 0.3 | 1.6 | 10% | 2 | Absent | 2.0 | G | 90 |
| Example 3B | ↑ | ↑ | Compound (1)' | 5.53 | Lubron L2 + 700 kGy | 0.3 | 2.3 | 10% | 0.8 | Absent | 1.8 | VG | 67 |
| Example 4B | ↑ | ↑ | Compound (2)' | 5.29 | TFE 4% 60 kGy | 0.3 | 1.7 | 10% | 1.5 | Absent | 1.5 | VG | 40 |
| Example 5B | ↑ | ↑ | Compound (3)' | 5.32 | TFE 4% 60 kGy | 0.3 | 1.7 | 10% | 1.5 | Absent | 1.5 | VG | 45 |
| Example 6B | ↑ | ↑ | Compound (1)' | 5.53 | TFE 4% 60 kGy | 0.3 | 1.7 | 10% | 1.5 | Absent | 1.5 | VG | 66 |
| Example 7B | ↑ | ↑ | Compound (4)' | 5.60 | TFE 4% 60 kGy | 0.3 | 1.7 | 10% | 1.5 | Absent | 1.5 | VG | 74 |
| Example 8B | ↑ | ↑ | Compound (5)' | 5.63 | TFE 4% 60 kGy | 0.3 | 1.7 | 10% | 1.5 | Absent | 1.5 | VG | 90 |
| Example 9B | ↑ | ↑ | Compound (6)' | 5.65 | TFE 4% 60 kGy | 0.3 | 1.7 | 10% | 1.5 | Absent | 1.5 | VG | 130 |
| Comparative Example 1B | ↑ | ↑ | Compound (2)' | 5.30 | No filler | | | | | | — | — | 83 |
| Comparative Example 2B | ↑ | ↑ | Compound (4)' | 5.60 | No filler | | | | | | — | — | 111 |
| Comparative Example 3B | ↑ | ↑ | Compound (1)' | 5.53 | Lubron L2 | 0.3 | 0.6 | 10% | X | Absent | >30.0 | B | 122 |
| Comparative Example 4B | ↑ | ↑ | Compound (1)' | 5.53 | Lubron L2 | 0.3 | 0.6 | 10% | 20 | Present | 20.0 | B | 106 |
| Comparative Example 5B | ↑ | ↑ | Compound (1)' | 5.53 | Lubron L2 + 1000 kGy | 0.3 | 3.3 | 10% | 1.3 | Absent | 1.3 | VG | 51 |
| Comparative Example 6B | ↑ | ↑ | Compound (1)' | 5.53 | PFA MP101 | 2 | 0.7 | 10% | 20 | Present | 20.0 | B | 123 |
| Comparative Example 7B | ↑ | ↑ | Compound (7)' | 5.20 | TFE 4% 60 kGy | 0.3 | 1.7 | 10% | 1.5 | Absent | 1.5 | VG | 38 |
| Comparative Example 8B | ↑ | ↑ | Compound (1)' | 5.53 | TFE 4% 60 kGy | 0.3 | 1.7 | 1% | 1 | Absent | 1.0 | VG | 80 |
| Example 10B | ↑ | ↑ | Compound (1)' | 5.53 | TFE 4% 60 kGy | 0.3 | 1.7 | 7% | 1.4 | Absent | 1.4 | VG | 77 |
| Example 11B | ↑ | ↑ | Compound (1)' | 5.53 | Lubron L2 + 400 kGy | 0.3 | 1.6 | 18% | 2 | Absent | 2.0 | G | 103 |
| Comparative Example 9B | ↑ | ↑ | Compound (1)' | 5.53 | Lubron L2 + 400 kGy | 0.3 | 1.6 | 35% | 2 | Absent | 5.0 | NB | 155 |
| Example 12B | ↑ | ↑ | Compound (1)' | 5.53 | Lubron L2 + 400 kGy | 0.3 | 1.6 | 35% | 5 | Absent | 5.0 | NB | 99 |
| Example 13B | ↑ | ↑ | Compound (3)' | 5.32 | Lubron L2 + 400 kGy | 0.3 | 1.6 | 18% | 2 | Absent | 2.0 | G | 73 |

| | 2-(1) Electric properties | | | | | | 2-(3) | | | |
|---|---|---|---|---|---|---|---|---|---|---|
| | Evaluation | VL after 100k copying | ΔVL | Evaluation | Evaluation of electric properties | 2-(2) Image defect | Film loss amount | Evaluation | 2-(4) Nox resistance | Overall evaluation |
| Example 1B | G | 114 | 18 | G | G | G | 0.6 | G | G | VG |
| Example 2B | G | 104 | 14 | G | G | G | 0.6 | G | G | VG |
| Example 3B | VG | 89 | 22 | NB | NB | VG | 0.7 | G | G | G |
| Example 4B | VG | 46 | 6 | VG | VG | VG | 0.7 | G | NB | G |

TABLE 2-continued

| | | | | | | | | | | |
|---|---|---|---|---|---|---|---|---|---|---|
| Example 5B | VG | 53 | 8 | VG | VG | VG | 0.7 | G | G | VG |
| Example 6B | VG | 76 | 10 | VG | VG | VG | 0.7 | G | G | VG |
| Example 7B | G | 94 | 20 | G | G | VG | 0.7 | G | VG | VG |
| Example 8B | G | 118 | 28 | NB | NB | VG | 0.7 | G | VG | G |
| Example 9B | NB | 159 | 29 | NB | NB | NB | 0.7 | G | VG | NB |
| Comparative Example 1B | G | 90 | 7 | VG | G | G | 2.2 | B | B | B |
| Comparative Example 2B | NB | 152 | 41 | B | B | NB | 2.2 | B | VG | B |
| Comparative Example 3B | NB | 204 | 82 | B | B | B | | | | B |
| Comparative Example 4B | NB | 128 | 22 | NB | NB | G | 0.6 | G | G | B |
| Comparative Example 5B | VG | 122 | 71 | B | B | NB | 1.0 | NB | G | B |
| Comparative Example 6B | NB | 148 | 25 | NB | NB | NB | 0.5 | G | G | B |
| Comparative Example 7B | VG | 45 | 7 | VG | VG | | 0.7 | G | B | B |
| Comparative Example 8B | G | 95 | 15 | G | G | G | 2.3 | B | G | B |
| Example 10B | G | 85 | 8 | VG | G | G | 1.2 | NB | G | G |
| Example 11B | NB | 130 | 27 | NB | NB | G | 0.5 | G | G | G |
| Comparative Example 9B | B | 213 | 58 | B | B | B | 0.3 | VG | G | B |
| Example 12B | G | 118 | 19 | G | G | G | 0.3 | VG | G | G |
| Example 13B | G | 91 | 18 | G | G | G | 0.5 | G | G | VG |

The symbol "X" in TABLE 2 means "unmeasurable".

Table 2 has revealed that all the photoreceptors of Examples 1B to 13B according to the present invention had satisfactory results with respect to the evaluation items including electric properties, image defect, film loss amount, NOx resistance and overall evaluation, and can provide high wear resistance, stable and high electric properties, and high image quality.

On the other hand, Comparative Examples 1B to 4B and 6B in which no oxygen-containing fluorinated resin was added; Comparative Examples 3B and 4B in which oxygen-free and unirradiated PTFE fine particles were added; Comparative Example 5B in which oxygen-containing fluorinated resin was added, but the oxygen content of the resin, that is, the oxygen composition ratio of the particles is as high as 3.3% by atom; Comparative Example 7B in which compound 7' having an ionization potential of 5.20 eV was used as a charge transport material; Comparative Example 8B in which cross-linked PTFE fine particles were included, but the particulate solid content was as low as 1% by weight; and Comparative Example 9B in which cross-linked PTFE fine particles were included, but the particulate solid content was as high as 35% by weight had bad results of the overall evaluation and therefore have a problem for use as photoreceptors.

In the present invention, fluorinated fine particles polymerized by a specific method are included in an outermost layer of an electrophotographic photoreceptor. Thereby, the present invention can provide an electrophotographic photoreceptor which has high dispersion stability when in the form of a coating solution for photoreceptor formation and which has high wear resistance and is electrically stable over a long period of time; and an image forming apparatus including the electrophotographic photoreceptor.

Furthermore, in the present invention, oxygen-containing fluorinated fine particles polymerized by a specific method are included in an outermost layer of an electrophotographic photoreceptor, and a charge transport material having an ionization potential in a wide range from 5.25 to 5.70 eV, that is, from an ionization potential conventionally considered to be relatively low to a high ionization potential. Thereby, the present invention can provide an excellent electrophotographic photoreceptor which has improved dispersion stability when in the form of a coating solution for photoreceptor formation and therefore has a photosensitive layer in which a filler and the charge transport material are uniformly dispersed, and which has high wear resistance, and stable and high electric properties and image quality; and an image forming apparatus including the electrophotographic photoreceptor.

What is claims is:

1. An electrophotographic photoreceptor having a photosensitive layer formed on a conductive substrate, wherein the photosensitive layer contains oxygen-containing fluorinated fine particles in a surface layer thereof, and the oxygen-containing fluorinated fine particles have an oxygen composition ratio of 0.9 to 3.0% by atom based on the whole composition of the fine particles according to an X-ray fluorescence composition analysis.

2. The electrophotographic photoreceptor according to claim 1, wherein the oxygen-containing fluorinated fine particles are obtained by irradiating polytetrafluoroethylene fine particles with gamma radiation from cobalt-60 in the atmosphere or obtained from a tetrafluoroethylene monomer as a raw material by the steps of:

(a) irradiating a mixed solution of the tetrafluoroethylene monomer and acetone with ionizing radiation to polymerize the tetrafluoroethylene monomer so that the mixed solution will be a gel dispersion of polytetrafluoroethylene in acetone;

(b) cross-linking the polytetrafluoroethylene by irradiating the dispersion of the polytetrafluoroethylene in acetone with ionizing radiation to give a suspension of fine particles; and optionally (c) isolating oxygen-containing fluorinated fine particles from the suspension of the fine particles by separation and drying.

3. The electrophotographic photoreceptor according to claim 1, wherein the oxygen-containing fluorinated fine particles have an oxygen composition ratio of 1.0 to 3.0% by atom.

4. The electrophotographic photoreceptor according to claim 1, wherein the oxygen-containing fluorinated fine particles have an oxygen composition ratio of 1.1 to 2.5% by atom.

5. The electrophotographic photoreceptor according to claim 1, wherein the oxygen-containing fluorinated fine particles include primary particles having a median size (D50) of 0.1 to 2 μm.

6. The electrophotographic photoreceptor according to claim 1, wherein the photosensitive layer contains a charge transport material having an ionization potential of 5.25 to 5.70 eV.

7. The electrophotographic photoreceptor according to claim 1, wherein the photosensitive layer contains a charge transport material having an ionization potential of 5.30 to 5.60 eV.

8. The electrophotographic photoreceptor according to claim 1, wherein the photosensitive layer contains 1.0 to 40% by weight of oxygen-containing fluorinated fine particles in the surface layer thereof.

9. An image forming apparatus including:

a photoreceptor drum comprising the electrophotographic photoreceptor according to claim 1, a charger configured to charge the electrophotographic photoreceptor, an exposure unit configured to expose the charged electrophotographic photoreceptor to form an electrostatic latent image, a developing device configured to develop the electrostatic latent image on the electrographic photoreceptor into a toner image, a transfer charger configured to transfer the toner image onto a recording material, and a fixing device configured to fix the transferred toner image on the recording material.

* * * * *